US012575682B2

(12) United States Patent
Brown

(10) Patent No.: US 12,575,682 B2
(45) Date of Patent: Mar. 17, 2026

(54) ADJUSTABLE FURNITURE

(71) Applicant: Motus Mechanics Ltd., Cheltenham (GB)

(72) Inventor: Paul Brown, Cheltenham (GB)

(73) Assignee: Motus Mechanics Ltd., Cheltenham (GB)

( * ) Notice: Subject to any disclaimer, the term of this patent is extended or adjusted under 35 U.S.C. 154(b) by 993 days.

(21) Appl. No.: 16/749,369

(22) Filed: Jan. 22, 2020

(65) Prior Publication Data

US 2020/0154899 A1 May 21, 2020

Related U.S. Application Data

(63) Continuation-in-part of application No. 16/307,530, filed as application No. PCT/GB2017/051722 on Jun.
(Continued)

(30) Foreign Application Priority Data

| | | |
|---|---|---|
| Mar. 11, 2015 | (GB) | 1504140 |
| Jun. 13, 2016 | (GB) | 1610212 |
| Jul. 28, 2017 | (GB) | 1712186 |

(51) Int. Cl.

| | |
|---|---|
| ***A47C 20/12*** | (2006.01) |
| ***A47C 1/024*** | (2006.01) |
| ***A47C 20/04*** | (2006.01) |

(52) U.S. Cl.
CPC ..... *A47C 20/12* (2013.01); *A47C 1/0242* (2013.01); *A47C 20/041* (2013.01)

(58) Field of Classification Search
CPC ..... A47C 20/04; A47C 20/041; A47C 20/042; A47C 20/043; A47C 20/045;
(Continued)

(56) References Cited

U.S. PATENT DOCUMENTS

| | | | |
|---|---|---|---|
| 139,493 | A | 6/1873 | Bray |
| 638,466 | A | 12/1899 | Kelly |

(Continued)

FOREIGN PATENT DOCUMENTS

| | | |
|---|---|---|
| CA | 851402 | 9/1970 |
| CA | 851402 A | 9/1970 |

(Continued)

OTHER PUBLICATIONS

"Fits and Clearances" NSK.com, Sep. 29, 2013. https://www.bearing.co.il/FITS06.pdf (Year: 2013).*

(Continued)

*Primary Examiner* — Justin C Mikowski
*Assistant Examiner* — Amanda L Bailey
(74) *Attorney, Agent, or Firm* — Andrew F. Young, Esq.; NOLTE LACKENBACH SIEGEL

(57) ABSTRACT

An article of adjustable furniture has at least one support section and a drive mechanism operable to effect pivotal movement of the at least one support section, the drive mechanism including at least a first and a second component pivotally joined by a bearing assembly, such that operation of the drive mechanism causes pivotal movement between the first and second components so as to effect pivotal movement of the at least one support section.

19 Claims, 23 Drawing Sheets

Related U.S. Application Data

13, 2017, now Pat. No. 11,812,857, and a continuation of application No. PCT/GB2018/052151, filed on Jul. 27, 2018, and a continuation-in-part of application No. 15/557,192, filed as application No. PCT/EP2016/055381 on Mar. 11, 2016.

(58) Field of Classification Search

CPC ... A47C 20/046; A47C 20/047; A47C 20/048; A47C 20/12; A47C 20/14; A47C 20/16; A47C 20/18; A47C 20/027; A47C 1/0242; A47C 7/402; A47C 7/462; A47C 7/5068; A61G 7/015; A61G 1/0242; A61G 1/0244; A61G 1/024; A61G 1/0246; A61G 1/0248; A61G 1/025; A61G 1/026; A61G 5/006

See application file for complete search history.

(56) References Cited

U.S. PATENT DOCUMENTS 912,214 A 2/1909 Ward
1,238,078 A 8/1917 Ault
1,414,637 A 5/1922 Gell
2,379,080 A * 6/1945 Hillenbrand ..... A61G 7/015 5/618
2,497,395 A 2/1950 Cramer, Sr.
2,859,797 A 11/1958 Mitchelson
2,917,753 A * 12/1959 Portis ..... A61G 7/015 5/618
2,954,072 A 9/1960 Fossati
3,036,862 A 5/1962 Beierbach et al.
3,086,814 A 4/1963 Fletcher
3,121,589 A 2/1964 Schliephacke
3,202,453 A 8/1965 Richards
3,281,141 A 10/1966 Smiley et al.
3,369,767 A 2/1968 Greenfield
3,503,082 A * 3/1970 Kerwit ..... A61G 7/015 5/601
3,797,050 A 3/1974 Benot et al.
3,847,430 A 11/1974 Fletcher
3,873,152 A 3/1975 Garas
4,202,062 A 5/1980 Marcyan
4,212,495 A 7/1980 Gall
4,332,417 A 6/1982 Mizelle
4,344,422 A * 8/1982 Immel ..... A61G 7/05 5/616
4,547,017 A 10/1985 Lescure
4,635,999 A 1/1987 Simpson
4,700,920 A * 10/1987 Horn ..... A47C 3/0255 248/370
4,970,737 A 11/1990 Sagel
4,996,731 A 3/1991 Kruyt
5,112,109 A 5/1992 Takada et al.
5,246,266 A 9/1993 Ostergaard
5,469,591 A 11/1995 Nomura
5,625,913 A 5/1997 Singleton
5,640,730 A 6/1997 Godette
5,704,686 A 1/1998 May
5,785,384 A 7/1998 Sagstuen
5,819,345 A 10/1998 Basgall
5,897,462 A 4/1999 St. Germain
6,059,364 A 5/2000 Dryburgh et al.
6,101,648 A 8/2000 Sommerfeld et al.
6,343,392 B1 2/2002 Becker et al.
6,568,755 B1 5/2003 Groening
6,641,214 B2 11/2003 Veneruso
6,739,661 B1 5/2004 Dukes
7,219,958 B2 5/2007 Yamazaki et al.
7,390,060 B2 6/2008 Kristen
7,445,279 B2 11/2008 Crum
7,641,277 B2 1/2010 Lawson et al.
7,703,851 B2 4/2010 Nakaya et al.
7,997,654 B2 8/2011 Ferry et al.
8,303,036 B2 11/2012 Hankinson et al.
8,403,415 B2 3/2013 Lawson
8,418,290 B2 * 4/2013 Shih ..... A61G 7/015 5/616
8,424,964 B2 4/2013 Campbell et al.
8,534,758 B2 9/2013 Rivera
9,248,066 B2 * 2/2016 Tsukada ..... A61G 7/053
2002/0060483 A1 5/2002 Yoshida et al.
2002/0162170 A1 11/2002 Dewert
2002/0174487 A1 11/2002 Kramer et al.
2003/0172455 A1 9/2003 Roma et al.
2004/0103476 A1 * 6/2004 Barcesat ..... A47C 20/08 5/617
2004/0155504 A1 8/2004 Tada
2005/0210588 A1 9/2005 Loewenthal
2006/0143827 A1 7/2006 Wilming
2006/0225201 A1 10/2006 Kristen
2007/0120409 A1 5/2007 Leeds
2007/0158980 A1 7/2007 LaPointe et al.
2007/0174487 A1 7/2007 Busey
2008/0150329 A1 * 6/2008 Lawson ..... A47C 1/0355 297/84
2008/0189862 A1 * 8/2008 Matsuura ..... A47C 20/041 5/624
2008/0258512 A1 10/2008 Rogers
2009/0044339 A1 2/2009 Morin et al.
2009/0119876 A1 5/2009 Pecar et al.
2009/0178201 A1 7/2009 Lujan et al.
2011/0043005 A1 2/2011 Fischer
2011/0248530 A1 10/2011 Sartisohn
2012/0240337 A1 * 9/2012 Shih ..... A61G 7/015 5/616
2014/0041121 A1 2/2014 Shan
2014/0103688 A1 4/2014 Wilson
2014/0237723 A1 * 8/2014 Wysocki ..... A61G 7/015 5/613
2015/0028641 A1 * 1/2015 Stent ..... A47C 7/56 297/313
2017/0238716 A1 * 8/2017 Kramer ..... A47C 20/08
2018/0042392 A1 2/2018 Brown
2019/0142177 A1 5/2019 Brown
2020/0154888 A1 5/2020 Brown
2020/0154899 A1 5/2020 Brown
2022/0304476 A1 * 9/2022 Liu ..... A47C 20/08

FOREIGN PATENT DOCUMENTS

CH 597799 10/1975
CN 2356589 Y 11/1999
CN 101653396 A 9/2009
CN 202314169 7/2012
CN 203538846 U 4/2014
CN 104921892 A 9/2015
CN 106361047 A 1/2017
DE 029715343 1/1998
DE 201 06 465 6/2001
DE 010152227 5/2003
DE 20 2003 015 235 1/2006
DE 20 2005 015 275 1/2006
DE 20 2007 009 068 12/2007
DE 102007024218 11/2008
DE 10 2007 049 118 2/2009
EP 0146914 A2 7/1985
EP 1114597 A1 11/1995
EP 0781518 12/1996
EP 0774223 A1 5/1997
EP 0865960 3/1998
EP 1180352 A1 2/2002
EP 1 306 032 10/2002
EP 1 537 805 6/2005
EP 1 621 175 2/2006
EP 1 676 505 7/2006
EP 2 524 623 11/2012
EP 3468418 B1 4/2019
FR 2 780 256 12/1999
GB 0329834 5/1930
GB 0414464 8/1934
GB 0775679 5/1957

(56) References Cited

FOREIGN PATENT DOCUMENTS

| | | | | | |
|---|---|---|---|---|---|
| GB | 2 085 719 | | | 8/1980 | |
| GB | 2227932 | | | 8/1990 | |
| GB | 2472920 | | | 2/2011 | |
| GB | 2486335 | | | 6/2012 | |
| GB | 191322022 | | | 8/2014 | |
| GB | 2520430 | | | 11/2015 | |
| GB | 201610212 | | | 6/2016 | |
| GB | 0101239 | | | 8/2016 | |
| GB | 2552886 | A | | 2/2018 | |
| JP | 36-13946 | | | 5/1936 | |
| JP | S 58-43433 | B | | 3/1983 | |
| JP | 01214308 | | | 8/1989 | |
| JP | 08-173263 | | | 7/1996 | |
| JP | 08-308680 | | | 11/1996 | |
| JP | H09187481 | A | | 7/1997 | |
| JP | 11-244096 | | | 9/1999 | |
| JP | 2003-144262 | | | 5/2003 | |
| JP | 2004016558 | A | | 1/2004 | |
| JP | 2005 111126 | | | 4/2005 | |
| JP | 2011-510769 | A | | 4/2011 | |
| JP | 2012-72657 | A | | 4/2012 | |
| JP | 2013236762 | A | | 11/2013 | |
| JP | 2007091361 | A | | 3/2015 | |
| NO | 154452 | B | * | 6/1986 | |
| SE | C2 510 584 | | | 6/1999 | |
| TW | 201542186 | A | | 11/2015 | |
| WO | 96/29970 | | | 10/1996 | |
| WO | WO2004107916 | | | 12/2004 | |
| WO | WO 2005/051128 | | | 6/2005 | |
| WO | WO 2005/107533 | | | 11/2005 | |
| WO | WO 2006/023447 | | | 3/2006 | |
| WO | WO 2007/124067 | | | 11/2007 | |
| WO | WO 2008/129565 | | | 10/2008 | |
| WO | WO 2008/132481 | | | 11/2008 | |
| WO | WO 2011/021002 | | | 2/2011 | |
| WO | WO2011/048384 | | | 4/2011 | |
| WO | WO 2012/032305 | | | 3/2012 | |
| WO | WO 2012/099061 | | | 7/2012 | |
| WO | WO-2012128045 | A1 | * | 9/2012 | ..... A47C 20/048 |
| WO | WO 2013/061259 | | | 5/2013 | |
| WO | 2014/171253 | A1 | | 10/2014 | |
| WO | WO 2014/183112 | | | 11/2014 | |
| WO | WO 201/5011432 | | | 9/2015 | |
| WO | 2016/058949 | A | | 4/2016 | |
| WO | WO 2017216547 | A1 | | 12/2017 | |

OTHER PUBLICATIONS

Eng Translation of WO2012128045 (Year: 2012).*
U.S. Appl. No. 15/557,192, filed Sep. 11, 2017, Brown.
JP Appln. No. JP2018-566248, Office Action dated Sep. 29, 2020, 7 pages—English, 6 pages—Japanese.
U.S. Appl. No. 15/557,192, Office Action dated Nov. 9, 2020, 8 pages.
U.S. Appl. No. 15/557,192, Response to Office Action dated Nov. 13, 2020, 7 pages.
U.S. Appl. No. 16/307,530, Office Action dated Dec. 22, 2020, 20 pages.
Chinese Appln. No. 201780036988.9, Office Action dated Aug. 19, 2020, 10 pages—English, 16 pages—Chinese.
European Appln. No. EP 18 752 245.3, European office action dated Apr. 23, 2021, 4 pages—English.
CN 201680014490.8, Decision on Rejection, dated May 19, 2020, 4 pages—English, 5 pages—Chinese.
Canadian Pat. Appln.No. 3,026,473 issued Jul. 12, 2022, Office Action, 5 pages—English.
CN 201880058505.X, Second Office Action dated May 5, 2022, 3 pages—Japanese, 5 pages—English.
CN Serial No. 201880058505.X, Third Office Action dated Nov. 3, 2022, 6 pages—Chinese, 8 pages—English.
JP 2020-504132, Japanese Notice of Reasons for Rejection dated Oct. 4, 2022, 6 pages Japanese, 6 pages—English.
PCT/GB2018/052151, International Search Report and Written Opinion dated Sep. 7, 2018—12 pages—English.
GB 1712186.4, Combined Search and Examination Report dated Jun. 25, 2018, 20 pages—English.
PCT/GB2018/052150, Internationa Search Report and Written Opinon dated Sep. 7, 2018, 14 pages—Englsh.
PCT/GB2010/001565 International Search Report mailed Apr. 12, 2011, 6 pages—English.
GB1319926.0 Search Report dated May 1, 2014, 4 pages—English.
GB1419811.3 Search Report dated Dec. 17, 2014, 7 pages—English.
PCT/GB2014/000452 Search Report and Written Opinion, 9 pages—English.
PCT/GB2015/000314, Search Report and Written Opinion, mailed Jul. 3, 2016, 9 pages.
PCT/GB2017/051722, Search Report and Written Opinion mailed Sep. 5, 2017, 17 pgs.—English.
GB 1316684.8, Search Report and Written Opinion, dated Mar. 13, 2014, 7 pages—English.
PCT/GB2015/000315, International Search Report and Written Opinion, mailed Jul. 3, 2016, 9 pages—English.
GB1422032.1, Search Report dated Apr. 29, 2015, 2 pages—English.
Pat. No. GB 1417108.6, Combined Search and Examination Report dated Mar. 26, 2015, 7 pages—English.
EasyCliner® wood-to-the-floor recliner mechanism, 1 page, HomeFurnitureComponents.com, Apr. 10, 2015.
GB1313002.6, Search Report mailed Jan. 21, 2014, 4 pages.
PCT/GB2014/000274, Written Opinion mail Jan. 21, 2014, 5 pages.
U.S. Appl. No. 13/390,985, filed Feb. 17, 2012, Office Action mailed Jan. 7, 2015, 20 pages.
JP 2020-504132, Translation of Decision to Refuse dated May 16, 2023, 4 pages—English, 3 pages—Japanese.
Canadian Intellectual Property Office, Office Action in Application No. 3,071,465, dated Nov. 19, 2024, 4 pg.
European Patent Office, Examination Report in Application No. 18 752 245.3, dated Oct. 11, 2023.
CN 20180058505.X, Chinese Office Action dated Jul. 30, 2021, 9 pages—Chinese; 14 pages—English, Certificate of Translation—1 page—English.

* cited by examiner

ADJUSTABLE FURNITURE

CROSS REFERENCE TO RELATED APPLICATIONS

This application is a continuation (CON) of PCT Ser. No.: PCT/GB2018/052151 (WO 2019/021026) filed Jul. 27, 2018, the entire contents of which are incorporated herein by reference, which in turn claims priority to GB 1712186.4 filed Jul. 28, 2017.

This application is also a continuation-in-part (CIP) of U.S. Ser. No. 15/557,192 filed Sep. 11, 2017, the entire contents of which are incorporated herein by reference, which is a 371 National Phase of PCT/EP2016/055381 filed Mar. 11, 2016, the entire contents of which are incorporated herein by reference, which claims priority to GB 1504140.3 filed Mar. 11, 2015.

This application is also a continuation-in-part (CIP) of U.S. Ser. No. 16/307,530 filed Dec. 6, 2018, the entire contents of which are incorporated herein by reference, which is a 371 National Phase of PCT/GB2017/051722 filed Jun. 13, 2017, the entire contents of which are incorporated herein by reference, which claims priority to GB 160212.1 filed Jun. 13, 2016.

FIGURE SELECTED FOR PUBLICATION

FIG. 6*a*.

BACKGROUND OF THE INVENTION

Field of the Invention

The present invention relates to an article of adjustable furniture such as a chair or a bed, and in particular concerns adjustable furniture having one or more adjustable support sections which can be moved to adjust the configuration of the furniture.

Description of the Related Art

Known articles of adjustable furniture comprise complex mechanisms driven by one or more actuators between different configurations. US2002/0174487 discloses a hospital bed having adjustable back and thigh sections for supporting the occupant in various positions, for example in a flat horizontal position, in a recumbent or semi-recumbent position or simply with the backrest raised. The hospital bed of US2002/0174487 comprises a frame having a pair of parallel and spaced apart first and second side frame members; a mattress support deck including an adjustable back; a fixed seat section located adjacent to the back section; and, an adjustable thigh section located adjacent to the seat section. The thigh section is movable longitudinally relative to the seat section, to increase the length of the thigh section as it is raised relative to the frame. First and second curved tubes are coupled to respective first and second sides of the back section. A plurality of rollers are coupled to the first and second side frame members, with the rollers being configured to support the first and second curved tubes to permit movement of the curved tubes and the backrest section relative to the frame. A linear actuator is disposed beneath the back rest section and coupled to the first and second tubes to move the back rest section from a horizontal position to an elevated position relative to the frame. Two concentric arcuate tubes are provided on each side of the bed which have a radius of curvature centered on a location which emulates the natural hip pivot of a person lying on the mattress of the bed. The tubes are secured between three rollers on each side of the bed. Two rollers are located on a bottom side of the radially outer tube, that is to say radially outwards thereof, and the third roller is located on a top side of the radially inner tube. Cross-members extend between the tubes. The arrangement provides a so called shear-less pivot mechanism in which the adjustable back section pivots about 30 the natural hip point of the person on the bed.

The arrangement disclosed in US2002/0174487 may be considered heavy, robust and mechanically complex.

In a modern domestic setting, where mattress thicknesses of 12 to 18 inches are common, and more typically 14 to 18 inches in the United States, the overall weight, stiffness and rigidity of the mattress can place an unacceptable load on the operating mechanism of the bed, for example thicker, heavier mattresses can cause the motor (actuator) to struggle and reduce the longevity of the motor and mechanism. This is becoming increasingly relevant as the market place is driven by customer demand for thicker mattresses. Motorised adjustable beds have been known to fail after a short number of cycles using mattresses of the afore-mentioned thickness. One way to overcome this has been to use special, more flexible, "ribbed" mattress. However, this is not a practical solution for most applications.

A further problem associated with known designs is the requirement for the operating mechanism to be as compact as possible to free up space underneath the bed. In domestic beds, this space is often used to house drawers for storage, and therefore the more compact, or thinner the mechanism, the greater the storage capability.

ASPECTS AND SUMMARY OF THE INVENTION

According to one aspect of the present invention, there is a requirement for an adjustable article of furniture which addresses the aforementioned problems associated with known designs, which is at least as easy to manufacture, store, transport, deliver and assemble as non-adjustable furniture of known designs.

Thus according to one alternative aspect of the present invention, there is provided an article of adjustable furniture comprising at least one support section and a drive mechanism operable to effect pivotal movement of the at least one support section, the drive mechanism including at least a first and a second component pivotally joined by a bearing assembly, such that operation of the drive mechanism causes pivotal movement between the first and second components so as to effect pivotal movement of the at least one support section.

The provision of a bearing assembly for pivotal components of a drive mechanism enables more efficient use of the actuator. A result of more efficient actuator use is the ability of the actuator to drive the support sections from a shallower angle, which enables more compact mechanisms to be used, freeing up space within the furniture.

The above and other aspects, features and advantages of the present invention will become apparent from the following description read in conjunction with the accompanying drawings, in which like reference numerals designate the same elements.

DETAILED DESCRIPTION OF THE PREFERRED EMBODIMENTS

Figure 1:
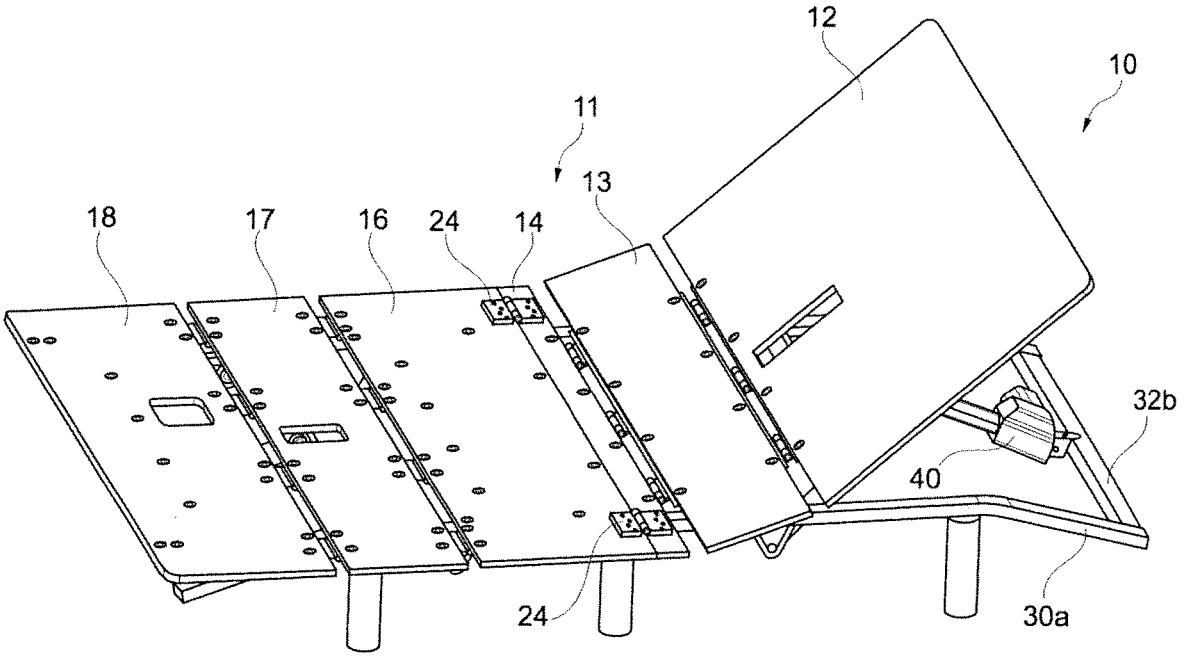
FIG. 1 is a perspective view from above of a frame and operating mechanism of an adjustable bed according to one embodiment of the present invention, with the bed in a semi-upright configuration for supporting an occupant in a seated position.

Reference will now be made in detail to embodiments of the invention. Wherever possible, same or similar reference numerals are used in the drawings and the description to refer to the same or like parts or steps. The drawings are in simplified form and are not to precise scale. The word 'couple' and similar terms do not necessarily denote direct and immediate connections, but also include connections through intermediate elements or devices. For purposes of convenience and clarity only, directional (up/down, etc.) or motional (forward/back, etc.) terms may be used with respect to the drawings. These and similar directional terms should not be construed to limit the scope in any manner. It will also be understood that other embodiments may be utilized without departing from the scope of the present invention, and that the detailed description is not to be taken in a limiting sense, and that elements may be differently positioned, or otherwise noted as in the appended claims without requirements of the written description being required thereto.

Figure 2:
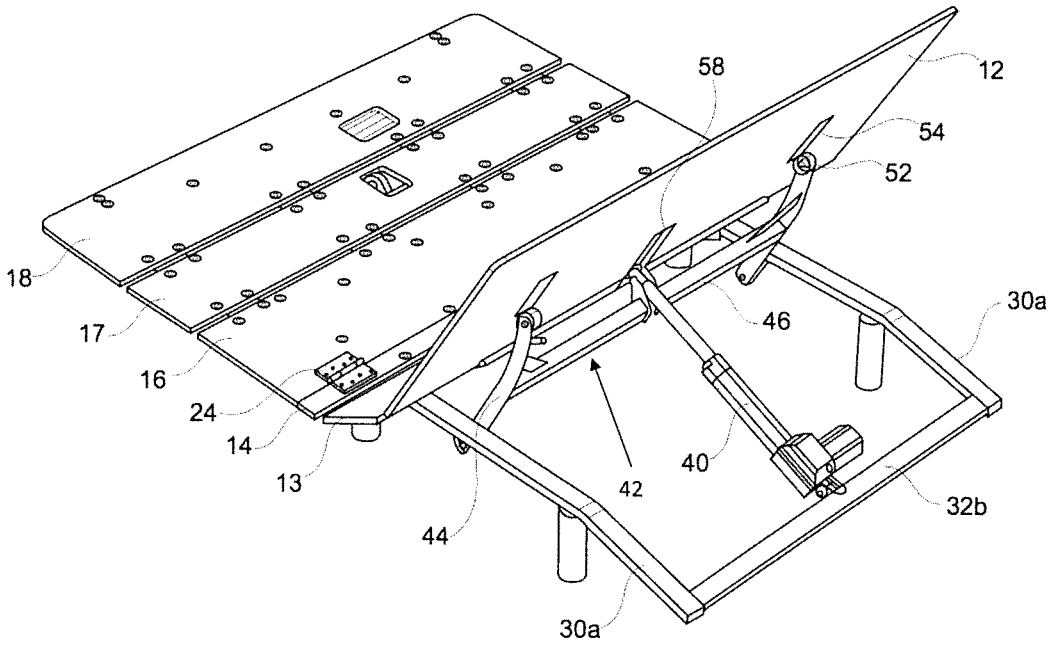
FIG. 2 is a perspective view from above and the rear, left hand side rear quarter, of the frame and operating mechanism of the adjustable bed of FIG. 1.

With reference to FIGS. 1 to 16, an article of adjustable furniture in the form of a bed 10 comprises a mattress support platform or deck 11 having a plurality of adjacent planar mattress support panels, including an adjustable back, neck and head (upper body) support section panel 12, a lumbar support section panel 13, a non-adjustable intermediate support section panel 14, a non-adjustable lower body support section panel 16, an adjustable thigh section panel 17 and a lower limb and foot support section panel 18. Throughout the drawings of FIGS. 2, 5, and 7 the panels 12-18 are shown in ghost outline in order to reveal the detailed construction of the adjustable bed 10. FIG. 6*a* shows a bed assembly including the adjustable bed 10 in the position of FIG. 6 with a mattress 50 supported on the deck 11. The mattress 50 is shown slightly elevated above the deck 11 for clarity, although it will be appreciated that the mattress 50 is in direct physical contact with the deck 11 in use. It will be appreciated that references to a mattress include both a separate mattress and a mattress integrated with the support sections or panels.

The panels 12-18 are mounted on a support frame 20. The upper body support panel 12 and lumbar support panel 13 are adjustably mounted on the support frame 20. The intermediate support panel 14 and lower body support section panel 16 are fixed in relation to the frame 20. The thigh support panel 17 and lower limb/foot support panel 18 are adjustably mounted on the support frame 20. The lumbar support section 13 has an upper surface 19, and the backrest support section 14 has an upper surface 21. An interior angle B, is defined between upper surfaces 19,21, the interior angle B always being less then 180 degrees when the bed moves towards the fully raised configuration such that the backrest section 14 is always tilted towards (anti-clockwise when viewing FIG. 4 such that a head of the occupant (not shown) is supported by the backrest support section.

The frame 20 comprises two half sections 20*a*, 20*b* hinged together at their respective adjacent ends. The two half sections include a head end sub-assembly 20*a* and a toe end sub-assembly 20*b*. The two half sections 20*a*, 20*b* are hinged together at their respective adjacent ends by hinges 24 fixed to the upward facing surface of the panels 14 and 16 at their respective adjacent edges, as can best be seen in FIGS. 1 and 10. The hinge arrangement is such that the two half sub-assemblies provide a full length structural support frame when hinged apart and locked into position, as shown in the drawings of FIGS. 1 to 8. The hinged sub-assemblies 20*a*, 20*b* allow the upper and lower halves of bed to be folded onto one another, as will be described in greater details below, for transportation, storage, distribution and delivery purposes.

The upper body support panel 12 and the lumbar support section panel 13 are adjustably mounted on the head end support frame sub-assembly 20*a*. The intermediate support panel 14 is fixedly mounted on the head end support frame subassembly 20*a*, adjacent to the lumbar support panel 13. The lower body panel 16 is fixed in relation to the toe end support frame sub-assembly 20*b* adjacent to the intermediate panel 14. The thigh support panel 17 and lower limb/foot support panel 18 are adjustably mounted on the toe end support frame sub-assembly 20*b* adjacent to the fixed lower body support section panel 16.

The lumbar support panel 13 is pivotally connected to the fixed intermediate support by means of a hinged joint 22 extending along the respective adjacent edges of the panels. As can best be seen in FIG. 9, the hinged joint 22 comprises a plurality of hinges 22' spaced along the edges of the adjacent edges of panels 13 and 14 within the region of the frame 20. The adjacent edges of the panels 13 and 14 are provided with respective elongate hinge mounting brackets 23*a*, 23*b*, preferably of metal construction, which extend on the underside of the panels 13 and 14 between the sides of the frame 20*a*, as can best be seen in FIG. 8. Three hinges 22' are provided, including a centrally located hinge and a pair at the respective ends of the elongate mounting brackets 23*a*, 23*b*. In the illustrated embodiment, the hinges 22' are conventional design and construction and are fixedly secured to the respective mounting brackets to pivotally mount the lumbar support panel to the fixed intermediate support panel about the pivot axis of the hinge 22.

The upper body support panel 12 is similarly pivotally connected to the lumbar support panel by means of a hinged joint 25 extending along the respective adjacent edges of the panels. The hinged joint 25 comprises a plurality of hinges 25' spaced along the edges of the adjacent edges of panels 12 and 13 within the region of the frame 20. The adjacent edges of the panels 12 and 13 are provided with respective elongate hinge mounting brackets 26*a*, 26*b*, preferably of metal construction, which extend on the underside of the panels 12 and 13 between the sides of the frame 20*a*, as can best be seen in FIG. 8. Three hinges 25' are provided, including a centrally located hinge and a pair at the respective ends of the elongate mounting brackets 26*a*, 26*b*. In the illustrated embodiment, the hinges 25' are conventional design and construction and are fixedly secured to the respective mounting brackets to pivotally mount the upper body support panel 12 to the lumbar support panel about the pivot axis of the hinge 25.

Hinges 22' and 25' may be conventional pin bracket type hinges or, in other embodiments, constructed of a fatigue resistant plastics material, for example as a so called "living hinge". Other types of hinge are also contemplated including extruded metal tubes, for example extruded aluminium or aluminium alloy, having a d or p shape cross-section, including a longitudinal mounting flange as an integral part of the extrusion, where a hinge pin passes through the extruded tube in a known manner and optionally mounted on bearings (ball bearing type) located at the respective ends of the tube to support the hinge pin in a low friction manner. In preferred embodiments, at least hinges 25' are provided with limited angular adjustment so that the adjustable panel 12 has a limited downward angular adjustment with respect to the lumbar support panel 13. In the illustrated embodiment, the hinge 25 is provided with an abutment stop in the form of a rectangular, preferably metal, plates 27 that are fixedly secured or connected to the hinge mounting bracket 26*a* in the region of the hinges 25'. The plates 27 are positioned on the underside of the hinge 25 and prevent panel 12 being lowered beyond the plane of panel 13 by mutual abutment of the plates 27 and the underside of the mounting brackets 26*b*. Thus, when the panels 12 and 13 are lowered flat they remain 180 degrees apart.

Hinges 22' and 25' are also limited upwards so each platform section 12. 13 cannot go beyond this angle relative to the previous panel section it is hinged to (typically 30 degrees, or the total combined angel of angular adjustment divided by the number of intermediary platform sections). Hinges 22' and 25' are also limited downwards so each platform section cannot fall below parallel to the previous section it is hinged to.

As will be described in greater detail below, panels 12 and 13 may be raised by a predetermined maximum amount about their respective pivot axis during adjustment of the bed, for example 65 degrees, combined, from the horizontal plane as defined by the flat orientation of fixed intermediate support panels 14 and 16 of the bed. Hinges 22 and 25 are provided with stop means to limit the degree of relative angular adjustment of the panels 12 and 13. Typically the maximum combined angular adjustment of the panels is 65 degrees with respect to the plane of the fixed non-adjustable panel 14. The hinges 22 and 25 may thus be adapted so that they contribute to the maximum angular adjustment of the panels 12 and 13 by equal amounts or substantially equal amounts, for example, 50/50 or 40/60 depending on the particular application and maximum angel of adjustment required.

As previously described, in embodiments of the present invention, the maximum combined angle of adjustment of the backrest and lumbar support sections is typically 50-65 degrees. In the illustrated embodiment, the angle of adjustment is shared between hinges 22 and 25 connecting each side of the lumbar support platform. The hinge axes are preferably 200-300 mm apart in the longitudinal direction of the bed, as best seen from the view of FIG. 9. In the illustrated embodiment, a single lumbar support platform having a length dimension of 250 mm is preferred.

Figure 5:
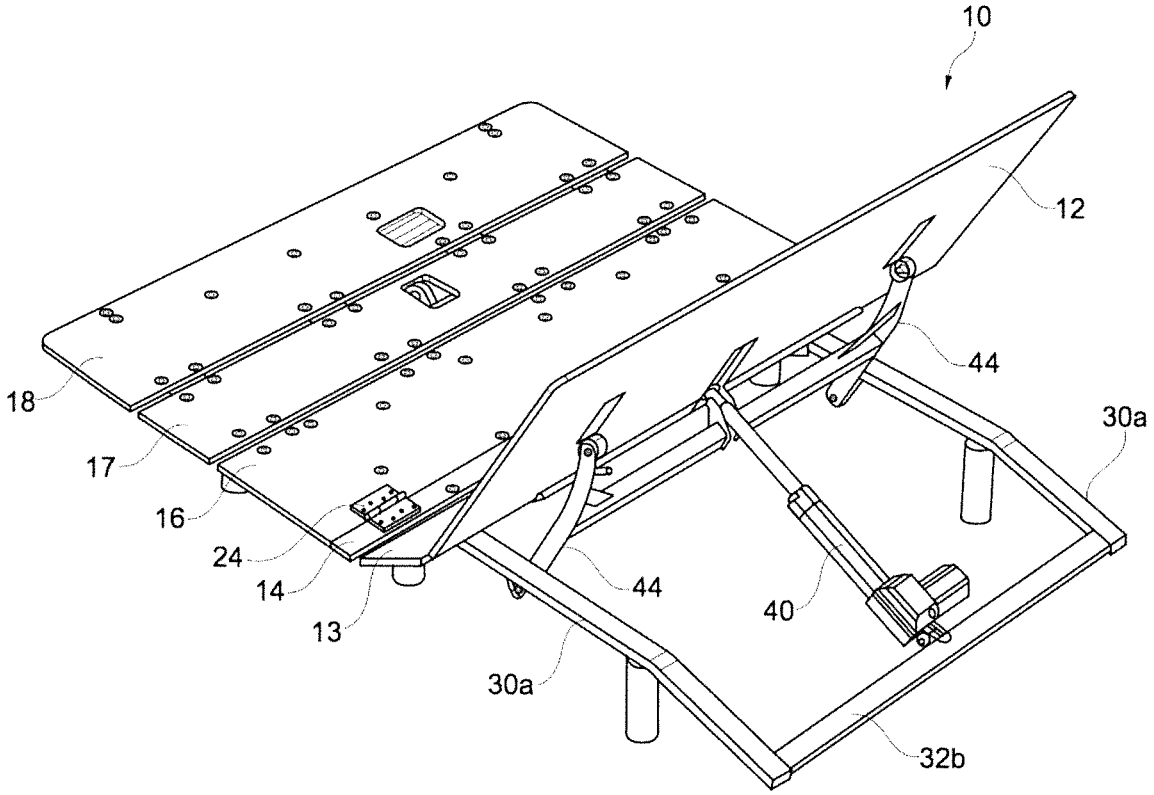
FIG. 5 is a perspective view similar to FIG. 2 with the bed in a fully upright adjusted position.
Figure 6:
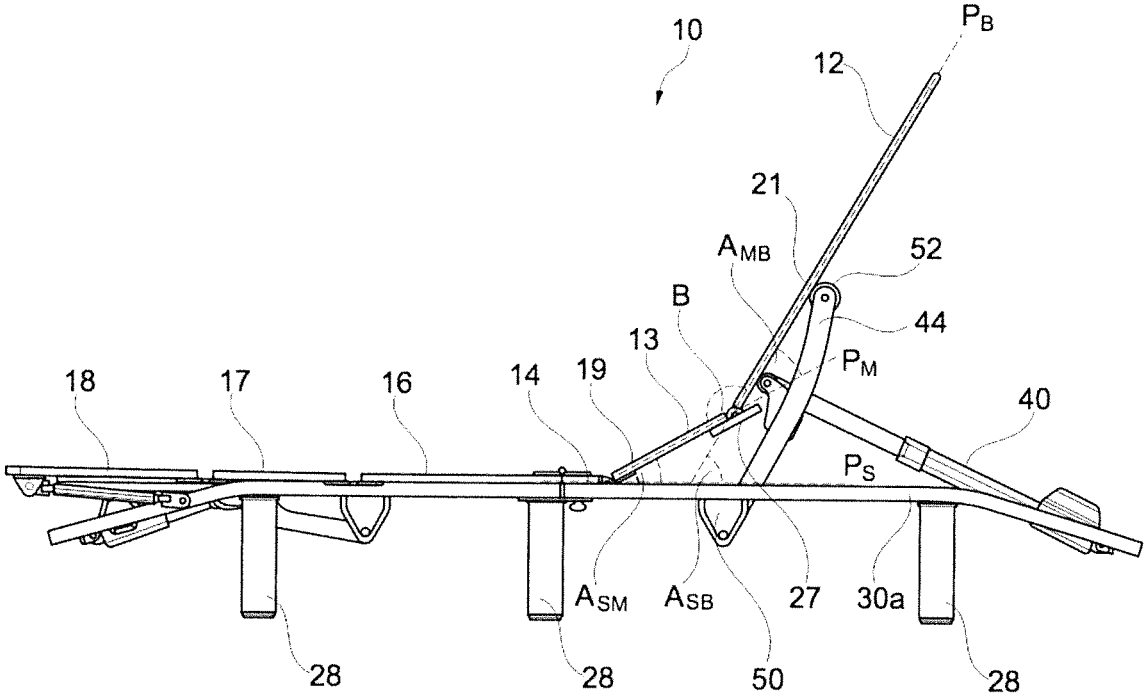
FIG. 6 a side elevation view of the bed similar to FIG. 4, with the bed in the fully upright adjusted position of FIG. 5.
Figure 6A:
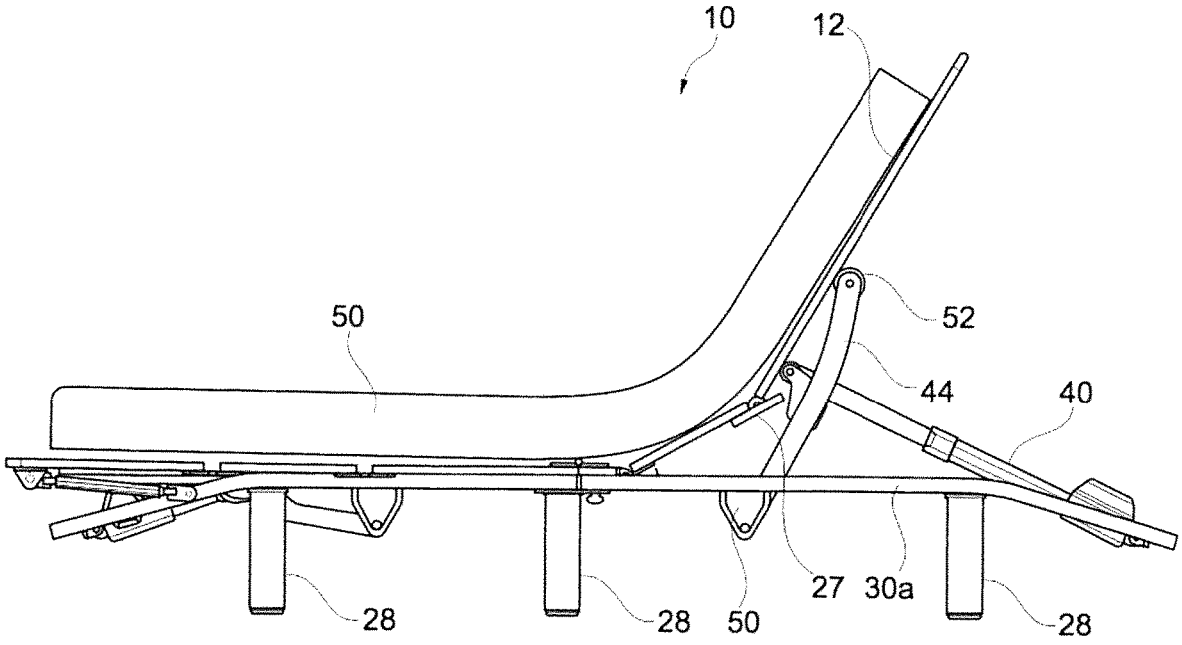
FIG. 6*a* is a side elevation view of the bed of FIG. 6 with a mattress supported thereon.

In FIGS. 5 and 6 the bed 10 is shown in a fully articulated configuration, adjusted for supporting an occupant in a raised upright seated position. In this position, the upper body support section panel 12 and the lumbar support section panel 13 are raised, and inclined with respect to, the fixed intermediate support section panel 14. The upper body support section panel 12 is raised about its pivot axis defined by hinge 25 and the lumbar support panel 13 is raised about its pivot axis defined by hinge 22.

Referring to FIG. 6, it can be seen that the combined angle ASB is defined between a plane PS defined by the seat section 16 and a plane PB defined by the backrest support section 12, the combined angle ASB being shared between a first angle ASM defined between the seat section plane PS and a plane PM defined by the lumbar support section 13, and a second angle AMB defined between the plane PM defined by the mattress support section 13 and the plane PB defined by the backrest support section 12.

In the lowered position (FIGS. 7 and 8) the adjustable support panels 12, 13 combine with the fixed panel 14 and fixed panel or seat section 16 and adjustable panels 17 and 18 to define a substantially flat planar horizontal mattress support platform or deck. The various support panels 12-18 may each have a mattress support cushion (not shown) of pre-determined thickness, which combine to provide a mattress foundation for supporting a suitable mattress. Alternatively, a mattress may be positioned directly on top of the panels 12-16. The panels 12-16 may be upholstered, with or without support cushions. The present invention also contemplates arrangements where the frame 20 is configured to be placed within the internal space of a bed surround, for example of the type common in North America, or integrated in a divan type bed foundation structure, more typically found in the United Kingdom. In the illustrated embodiment, the bed frame 20 is provided with floor standing legs 28 and is thus self-supporting. Thus, the present invention also contemplates arrangements where the frame 20 is arranged to be positioned within a separate surrounding structure, for example a decorative wood or upholstered surround including head and toe boards and lateral side panels between the head and toe boards. The dimensions of the bed are such that the bed has the size of a double bed, but the present invention contemplates beds of many different widths including standard single size beds to much larger doubles.

The half frame sub-assemblies 20*a* and 20*b* each comprises a generally rectangular structural support frame, preferably constructed of metal but other materials may be used for various component parts, in addition to or instead of metal, including board type material, for example engineering plastic, MDF, timber or other fibre type board for example.

The two half sections 20*a* and 20*b* each comprise a pair of elongate parallel lateral side frame members in the form of respective side rails 30*a*, 30*b*. The side frame members extend longitudinally along the length of the bed on both sides thereof and are joined together at their respective ends by metal, preferably steel, cross-members 31*a*, 31*b*, 32*a*, 32*b* to form rectangular box type structural support frames 20*a*, 20*b*.

The side frame members 30*a*, 30*b* are constructed of suitably dimensioned box section metal tube, preferably steel, and the cross-members 31*a* and 32*b* of similar rectangular box section metal tube. The frame 20 is provided with legs 28 towards each of the corners of the rectangular frame structure and at an intermediate position at the end of the toe end sub-assembly 20*b*. The side members 30*a*, 30*b* and respective cross members 31*a*, 31*b* and 32*a*, 32*b* are joined together by welding or alternatively by fixing means such as screws, bolts, fasteners or the like. In preferred embodiments, the legs are attachably/detachably fixed to the frame by suitable reversible fixing means as are well known in the art, for example screw thread fittings.

The two half sub-assemblies 20*a* and 20*b* are provided with locking means for locking the frame members 30*a*, 30*b* together when the frame 20 is unfolded. The locking means comprises a metal plate 33 secured on the underside of the respective side frame members 30*b* in the region of the hinged connection 24. The metal plate 33 extends over the underside of the adjacent side frame member 30*a* and is attachably/detachably fixed thereto by suitable reversible fixing means, as are well known in the art, for example screw thread fittings, such as a butterfly or winged 5 nut/bolt connection 35 as in the illustrated embodiment.

Figure 9:
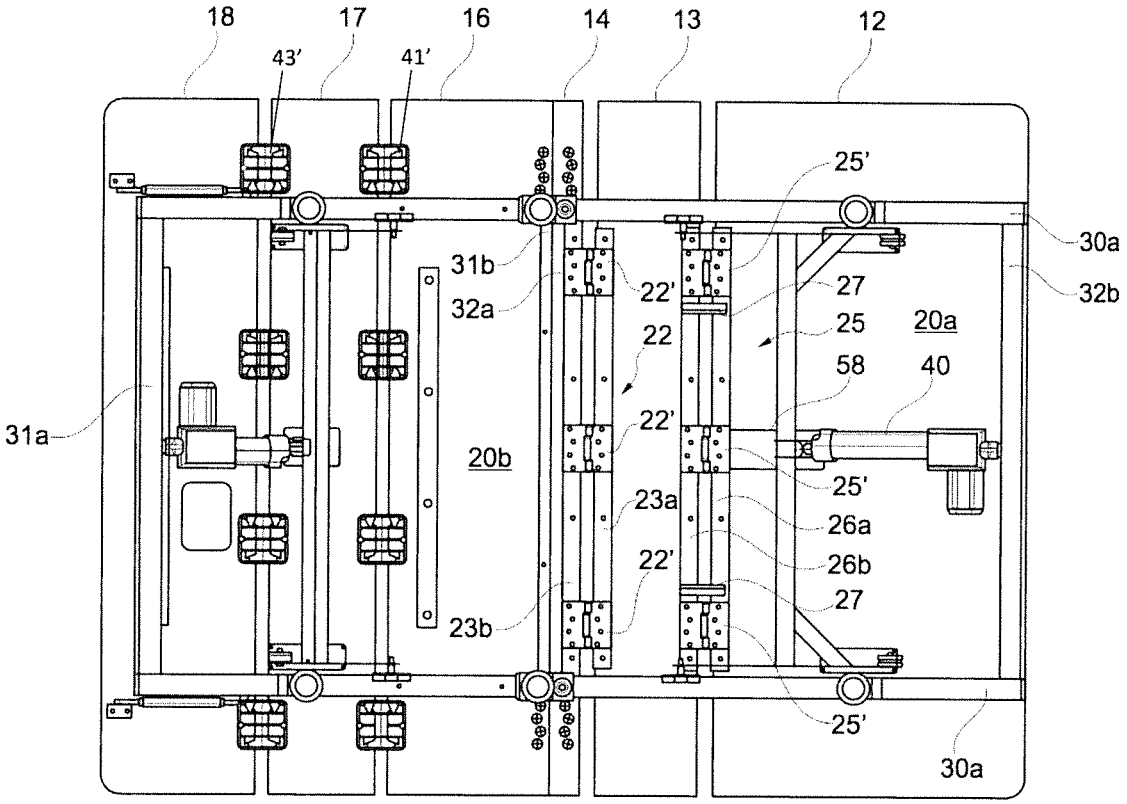
FIG. 9 is a perspective view of the bed of FIG. 1 with the bed viewed from below in plan.
Figure 10:
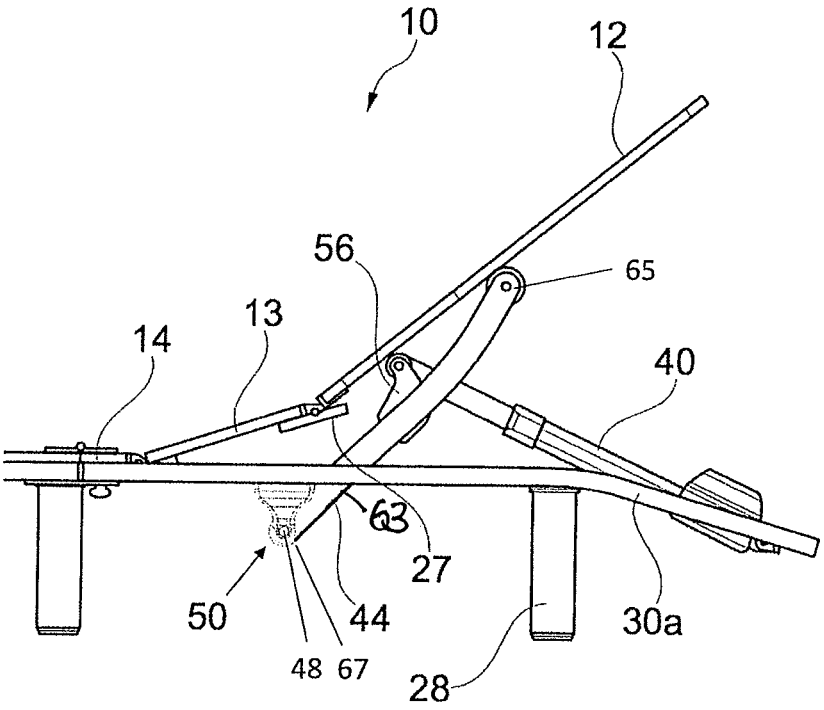
FIG. 10 is a side elevation view of the bed of FIG. 1 in a semi-upright configuration.
Figure 11:
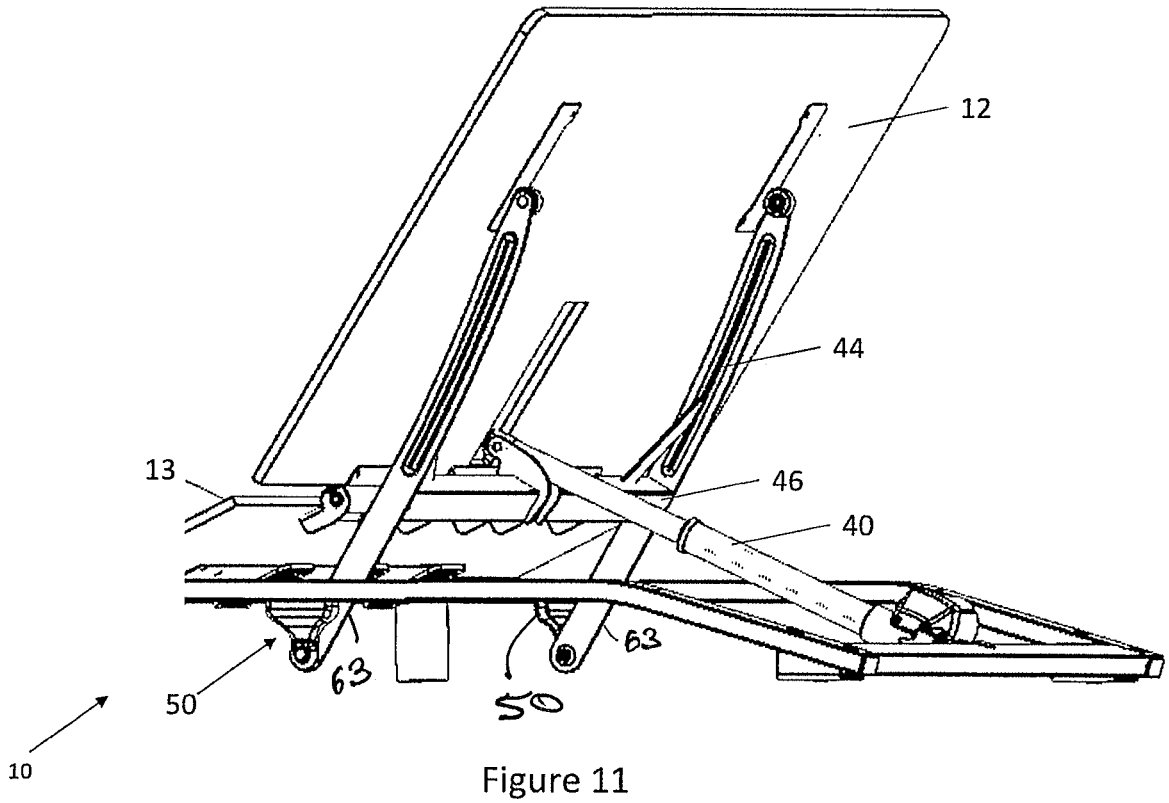
FIG. 11 is perspective view of the bed of FIG. 1 in a fully upright adjusted position.
Figure 12:
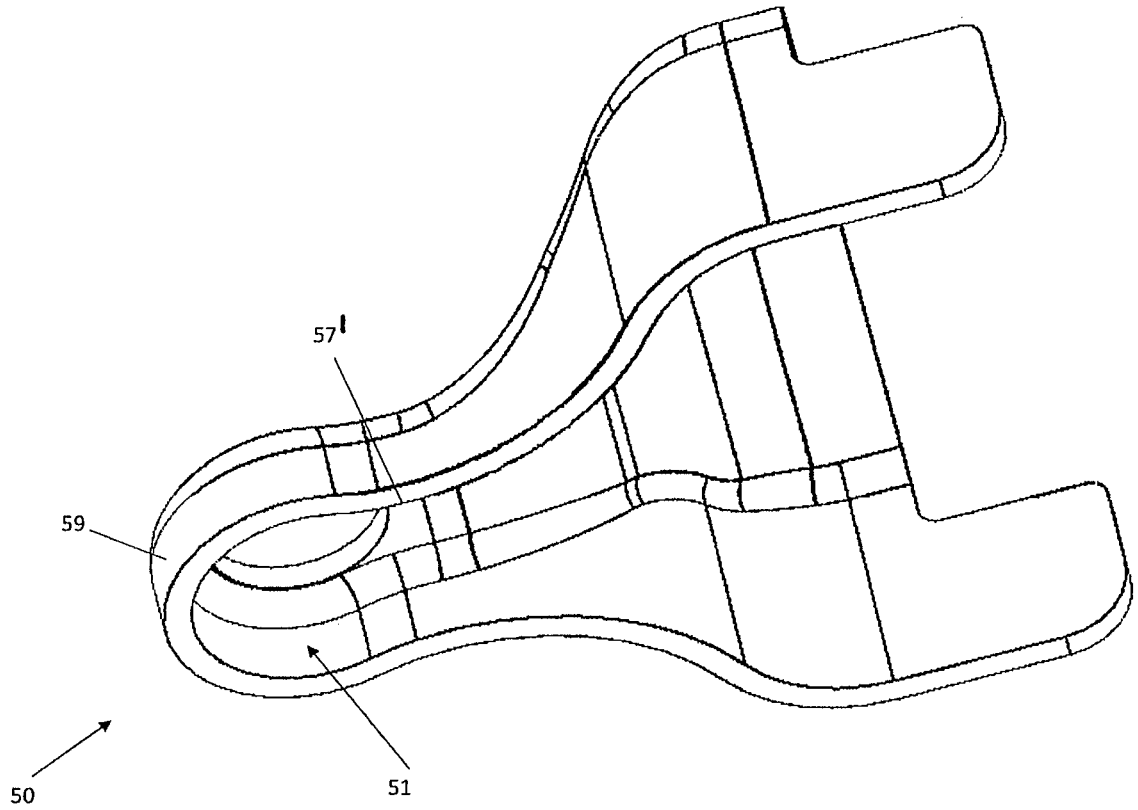
FIGS. 12 to 16 are enlarged perspective views of components of the bed of FIG. 1.
Figure 13:
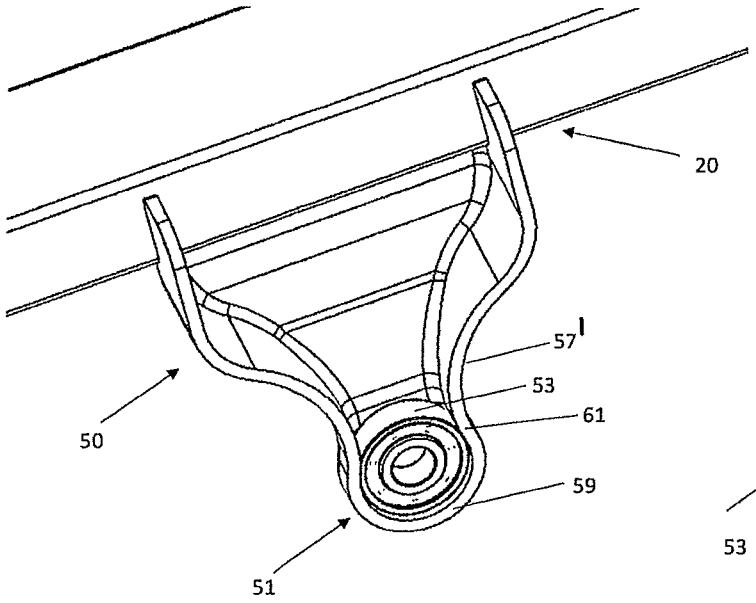
Figure 14:
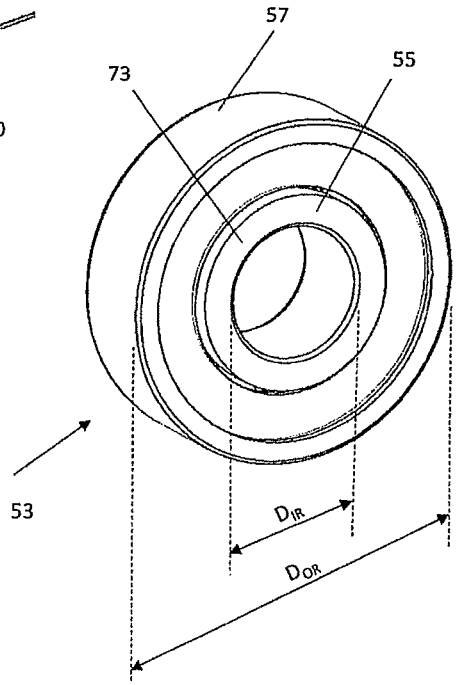
Figure 15:
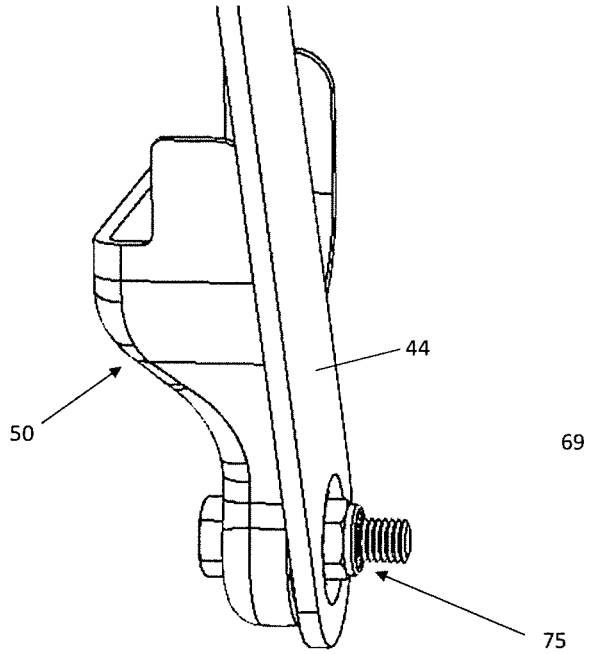
Figure 16:
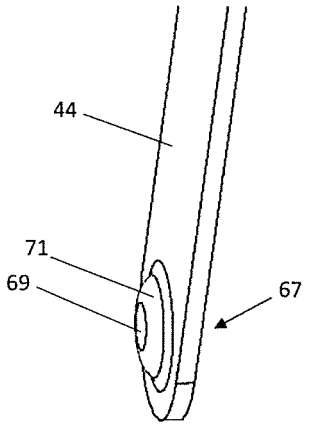

The unfolded and locked support frame 20 constitutes a floor standing base of the bed 10. The frame 20 may stand directly on legs 28 or alternatively be provided with castors, feet or the like at the end of the legs, as is well known in the art. Alternatively, the legs may be removed and the frame adapted to be mounted within a bed surround, for example with the side frame members sitting on a suitable mounting on the inside of a suitably adapted bed surround. As previously indicated, the frame 20 can be manually folded and unfolded about the traverse hinge axis defined by the hinge elements 24. Either the head end or toe end frame is moved so that the two half sections of the frame are brought together by 10 relative movement about the hinge axis as shown in FIGS. 9 and 10 where the panels 12 and 14 lie flat on top of the panel 16. As can be seen in FIGS. 9 and 10 when the legs 28 are unattached the adjustable bed 10 has a very small space envelope, with half the length dimension of the unfolded bed in exchange for a modest increase in depth, approximately the additional depth of the toe end half frame.

Movement of the adjustable panels 12 and 13 is effected by means of a powered actuation mechanism comprising a linear actuator 40 and a first connecting means in the form of a pivotal "H-frame" 42. The H-frame 42 comprises a pair of arms 44 and a cross-member 46 extending between and connecting the arms 44 approximately midway along their length. The arms 44 have a first distal end 65 and a second distal end 67 with an aperture 69 positioned towards the second distal end 67. Each arm 44 has a feature in the form of a raised portion 71 co-axial with the aperture 69. The arms 44 are generally straight but curve upwards at their first distal end 65 where a roller in the form of a bearing 52 is rotatably mounted. The bearings 52 contact the underside of the panel 12 along wear resistant strips 54 which may be of metal, nylon or the like, along which the bearings 52 run when the panel 12 is lowered and raised.

The H-frame is pivotally mounted at the second distal end of arms 44 on a second component in the form of a bracket 50 which is fixed to the underside of the head end sub-assembly frame 20*a* at pivot points 48. The brackets 50 depend from the underside of the frame 20*a* in the region of hinges 25. The bracket 50 includes an integral bearing housing 51 which is configured as described below to house and retain a bearing assembly 53.

In FIGS. 12 to 16, the bearing assembly 53 comprises an inner race 55 having an inner race internal diameter DIR, and an outer race 57 having an outer race external diameter DOR. The inner 55 and outer 57 races are rotationally moveable relative to each other. The bearing housing 51 has an external wall 57' which includes a part-circular section 59 and a crimped section 61 extending from the part-circular section 59. The crimped section 59 is formed after the bearing assembly 53 is located within the bearing housing 51 such that the bearing assembly 53 is both retained in, and is rotationally fixed with respect to the bearing housing 51. The arms 44 are pivotally attached to the bracket 50 by engagement of the raised portion 71 with an outer face 73 of the inner race 55, and are secured to the bracket 50 using a nut, bolt and washer arrangement 75 such that the arms 44 rotate with the inner race 55 relative to the outer race 57 which is rotationally fast with the bracket 50 which is fixed to the frame 20.

Figure 7:
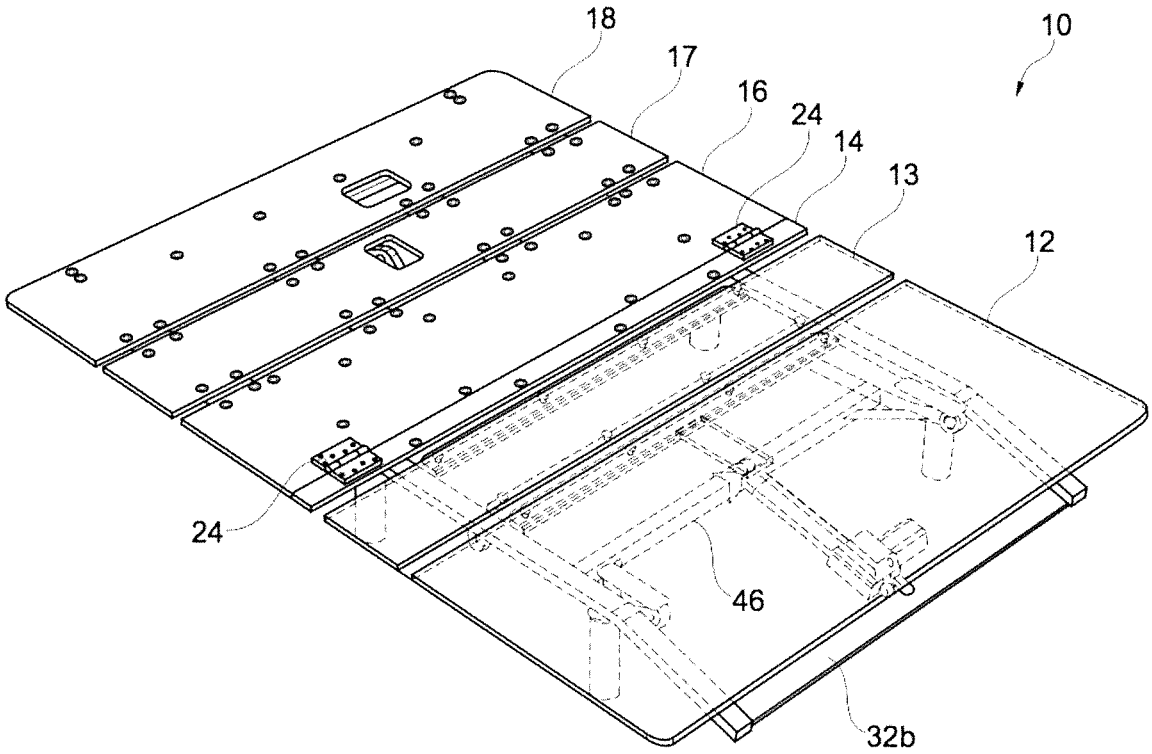
FIG. 7 is a perspective view similar to FIG. 2 with the bed in a fully lowered position, with part of the mattress support deck shown in ghost outline.
Figure 8:
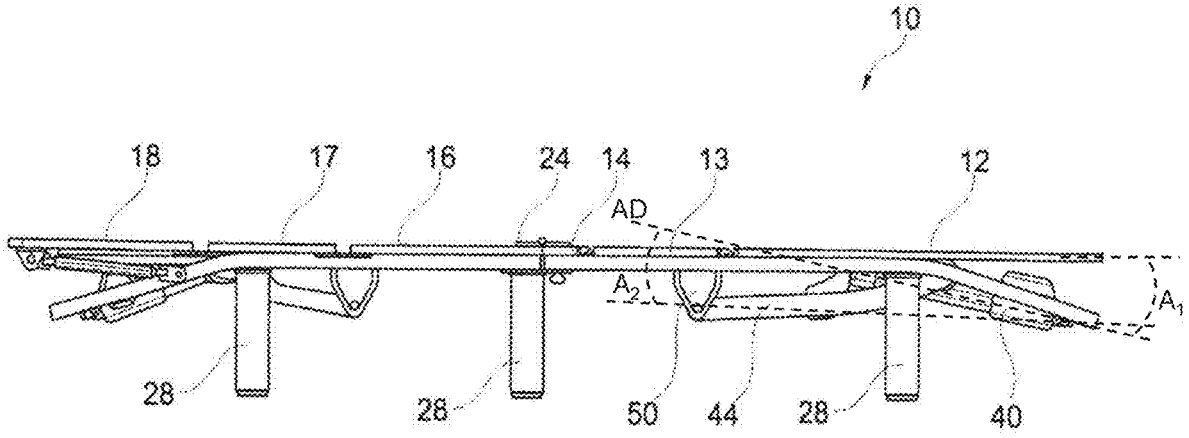
FIG. 8 a side elevation view of the bed, with the bed in the fully lowered position of FIG. 7.

The actuator 40 is a linear actuator of the Delta-drive type as produced by Dewert-Okin GmbH, having a first end (motor and gear box end) pivotally mounted to the cross member 32*b* and a second end (rod) pivotally connected to a bracket 56 secured to the cross-member 46. The bracket 56 is configured such that the connection between the output rod of the actuator and the bracket 56 is in the plane of the panel 12. This is achieved by means of a cut-out slot 58 in the panel 12 through which the bracket 56 and end of the output rod of the actuator extend. The gearbox and motor end of the actuator 40 is connected to the cross-member 32*b* at a position midway along its length. The cross-member 32*b* is located in a plane lower than the general or notional plane of the frame 20 due to the downwardly canted end of the frame 20*a*. The side members 30*a* are inclined downwards along the final third of their length from a position immediately rearward of the legs 28 attached to the frame 20*a*. The side members are inclined downwards approximately 20 degrees or so, so that the connection point between the actuator 40 and the frame 20*a* is below and offset from the notional plane of the frame 20. This arrangement ensures the actuator is also inclined with respect to the notional plane of the frame and the plane of the panel 12 when the panel 12 is in its lowered position (FIGS. 7 and 8). In combination with the other end of the actuator being in the plane of the panel 12, by means of the bracket 56 and cut out 58, the actuator 40 defining an actuator direction (AD) is able to apply a significant initial force to the panel 12 when the panel is to be raised from is lowered position of FIGS. 7 and 8. It is to be understood that the force component acting on the panel 12 when movement is initiated from its lowered position is dependent on the angular orientation of the actuator force vector with respect to the support section panel 12, wherein an angle ($A_1$) is defined between a plane of the support section panel 12, 18 in the lowered position and the actuator direction (AD) is less than 15 degrees; and wherein an angle ($A_2$) defined between a pivot point of a first end of the actuator 40 on the frame 20 and a pivot point between the first and second components and the actuator 40 is less than 15 degrees.

Rotational movement of the panel 12 is thus effected by activation of linear electrical actuator 40 positioned on the underside of the bed within the space envelope of the frame. Thus, panel 12 is raised and lowered by respective extension and retraction of actuator 40. In operation, in the fully lowered configuration of the bed, the adjustable panels 12 and 13 lie flat on the side rails 30*a*, with the output rod of actuator 40 fully retracted towards the respective gearbox end of the actuator. This position is shown in FIGS. 7 and 8. In order to raise the panels 12 and 13, the output rod of the actuator 40 is extended away from the gearbox end of the actuator. Rotational movement of lumbar support panel 13 is thus simultaneously effected by activation of linear electrical actuator 40. Panels 12 and 13 are this raised and lowered by extension and retraction of actuator 40.

The provision of a bearing assembly and housing at the pivotal connection of the arm 44 and the bracket 50 results in a significantly lower initial actuator force being required to move the panel when compared to using a conventional nut, bolt and washer arrangement. In alternative embodiments, a bearing assembly and housing arrangement can be provided at other pivotal connections to further reduce the initial actuator force requirement. For example, the bearing assembly and housing arrangement can be provided between the cross-member 46 of the H-bar 42 and the actuator 40 to provide a pivotal connection. An identical bracket to the bracket 50 of the embodiment of FIGS. 1 to 16 can replace the bracket 56 used to pivotally connect the cross-member 46 of the H-bar 42 and the actuator 40.

In preferred embodiments, the maximum combined angular adjustment of the panels 12 and 13 is 65 degrees, that is to say the maximum raised inclined angle of the backrest panel 12 with respect to the notional flat horizontal plane of the bed is limited to 65 degrees. This angle of adjustment includes the combined angle of adjustment of the lumbar support panel 13 with respect to the fixed panel 14 and the angle of adjustment of the backrest panel 12 with respect to the lumbar support panel 13. The combined angular adjustment may be less, for example, a maximum of 60, 55, 50 degrees or less, and may be contributed by equal amounts of angular adjustment by the panels 13 and 14. The maximum angular adjustment is determined by the geometry of the actuation mechanism including the mounting arrangement and the operation stroke of the actuator as well as the relative length dimensions of the respective adjustable panels.

It is to be understood that a mattress of appropriate thickness, say in the range of 25 to 50 cm (10 to 20 inches), is to be positioned on the mattress support platform of the bed 10.

Movement of the adjustable panels 17 and 18 is effected by means of a powered actuation mechanism comprising a linear actuator 40*a* identical to the actuator 40 driving panel 12, and a first connecting means in the form of a pivotal frame 42*a*. The frame 42*a* comprises a pair of arms 44*a* and a cross-member 46*a* extending between and connecting the arms 44*a*. The arms have a first distal end 65*a* which is connected to the underside of the panel 17, and a second distal end 67*a* which is pivotally mounted on a second component in the form of a bracket 50*a* which is fixed to the frame 20 at pivot points 48*a*. The brackets 50*a* depend from the underside of the frame 20 in the region of hinges 41'. In contrast to the pivotal connection between arms 44 and bracket 50 via a bearing assembly and housing arrangement, the arms 44*a* are pivotally attached to the bracket 50*a* using a simple nut, bolt and washer arrangement 75*a* such that the arms 44*a* rotate relative to the bracket 50*a* which is fixed to the frame 20. In an alternative embodiment, the bearing assembly 53 and bearing housing 51 described in relation to the movement of the panel 13 can be used to provide a pivotal connection between the arms 44*a* and the bracket 50 instead of the nut, bolt and washer arrangement. Similarly, the pivotal connection between the actuator 40*a* and the cross-member 46*a* can be provided by a bearing assembly and housing arrangement as described in relation to the pivotal connection between actuator 40 and cross-member 46.

Figure 3:
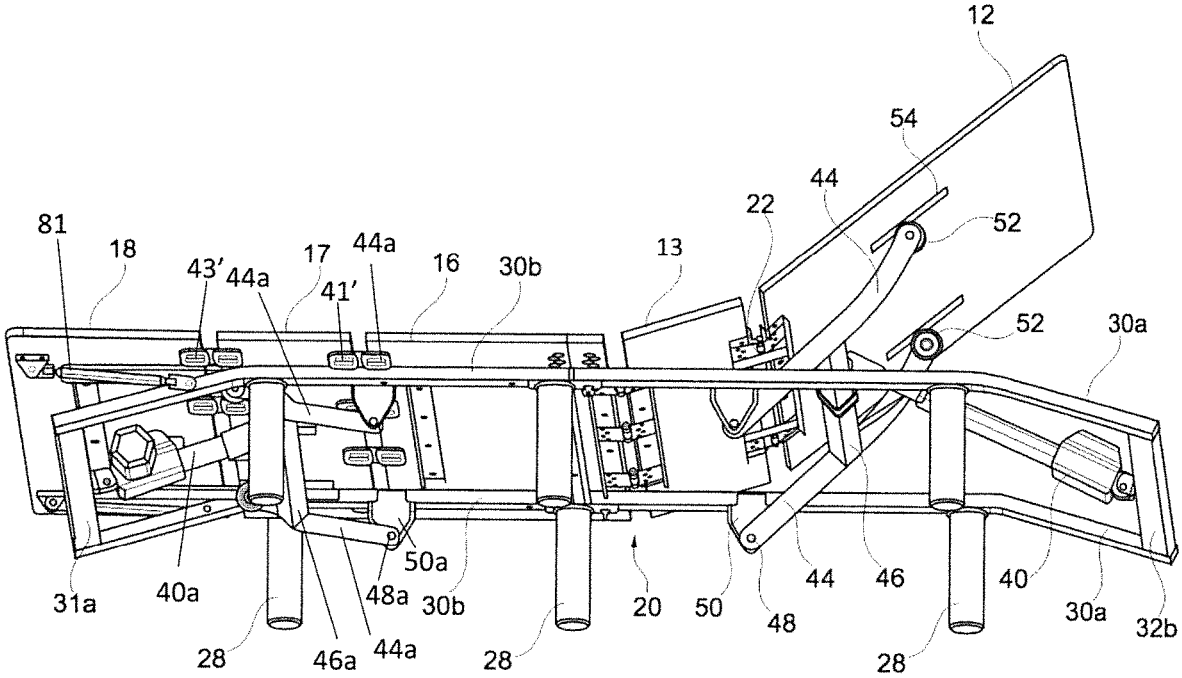
FIG. 3 is a perspective view of the bed of FIG. 1 with the bed viewed from below.
Figure 4:
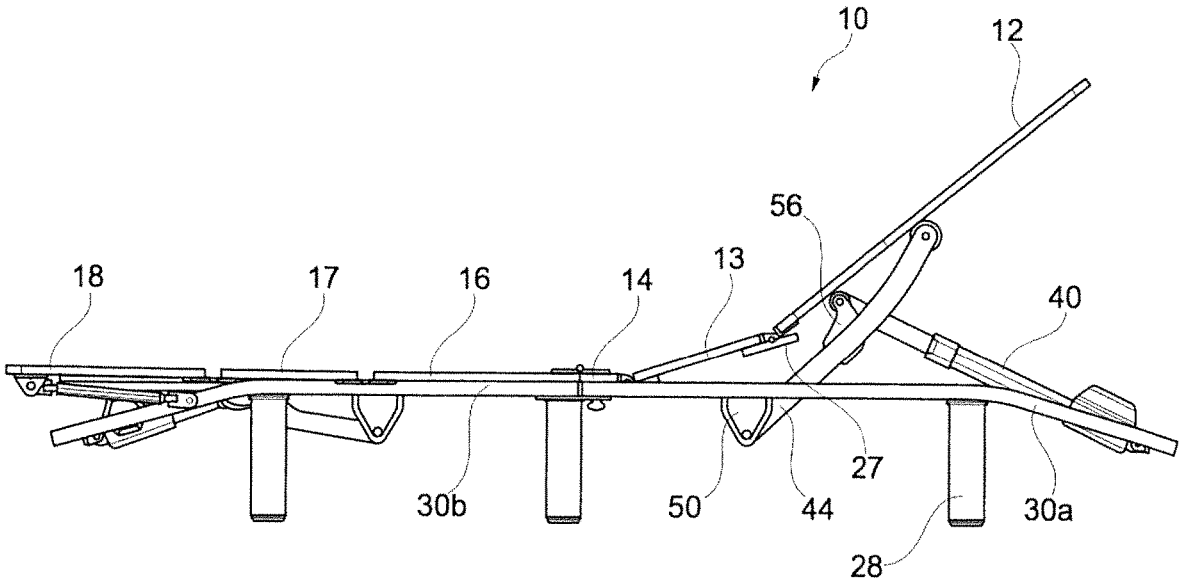
FIG. 4 a side elevation view of the bed of FIG. 1, with the bed in the semi-upright adjusted position of FIG. 1.

The actuator 40*a* has a first end (motor and gear box end) pivotally mounted to the cross member 31*a* and a second end (rod) pivotally connected to a bracket 56*a* secured to the cross-member 46*a*. Rotational movement of the panel 17 is thus effected by activation of linear electrical actuator 40*a* which causes the cross-member 46*a* and arms 44*a* to rotate. Thus, panel 17 is raised and lowered by respective extension and retraction of actuator 40*a*. Panel 18, by virtue of being connected to panel 17 via hinge 43' is also raised and lowered as panel 17 is raised and lowered. A brace 81 is fixed to the underside of panel 18 and the frame 20 to provide additional rigidity and support when panel 18 is under load (FIG. 3).

In the above described embodiments, panels 12 and 13 are rotated by an actuator 40 acting on panel 12 via arms 44, and panels 17 and 18 are rotated by actuator 40*a* acting on panel 17, that is to say, a first connecting means 44,44*a* acts on and engages with the respective panels 12,17. It is the fact that panels 17 and 18, and panels 12 and 13 are connected by respective hinges 43' and 25' which causes panel 18 to rotate as panel 17 is rotated, and panel 13 to rotate as panel 12 is rotated.

With reference to FIGS. 17 to 25, an alternative bed 110 is identical to the bed described in FIGS. 1 to 16 except that instead of a single connecting means acting on panel 17, a first connecting means or component in the form of a pair of arms 144*a* acts and engages with panel 118 and a second connecting means or component in the form of a pair of arms 190 which act on and engage with panel 117 such that an actuator 140*a*, which is identical to actuator 40*a*, simultaneously drives both panels 117,118.

Actuator 140*a* is connected to the frame 120 and to the cross-member 146*a* in the same way as actuator 40 is connected to the frame 20 and to the cross-member 46 of the embodiment of FIGS. 1 to 16.

Figure 20:
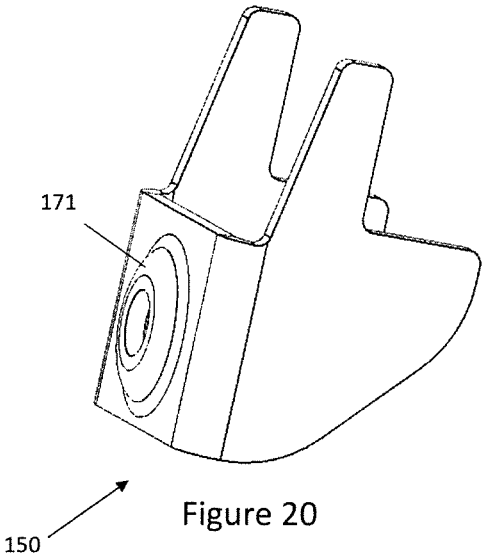
FIGS. 20 to 25 are enlarged perspective views of components of the bed of FIG. 17.
Figure 21:
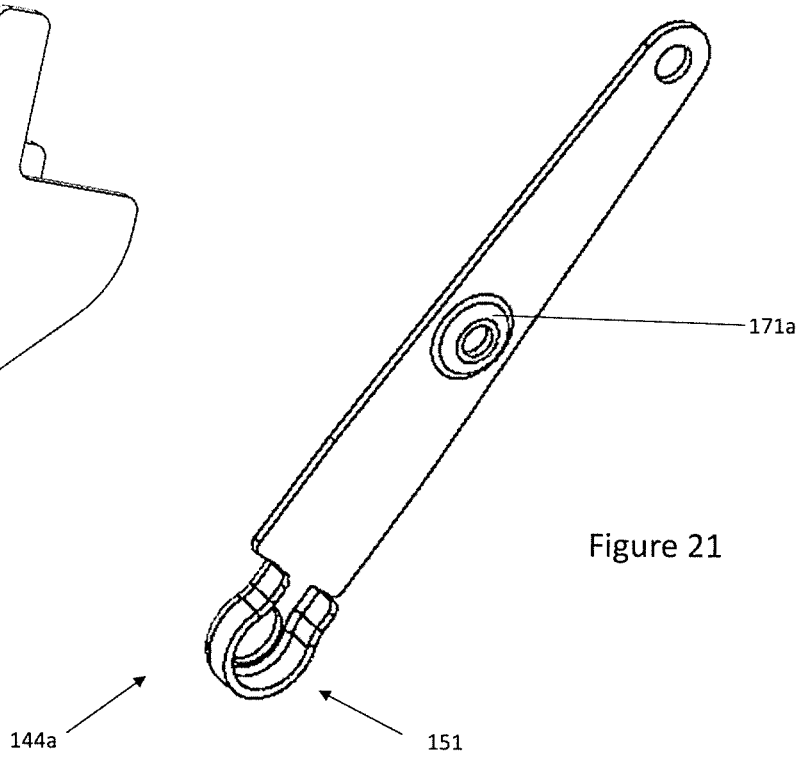
Figure 22:
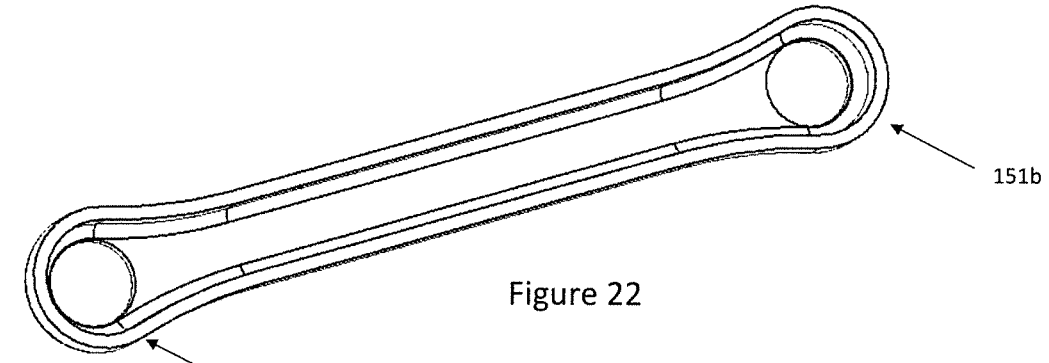
Figure 23:
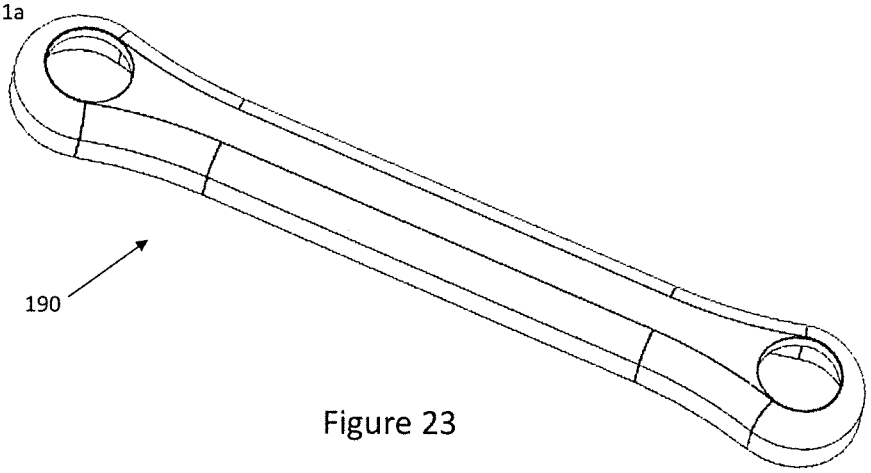
Figure 24:
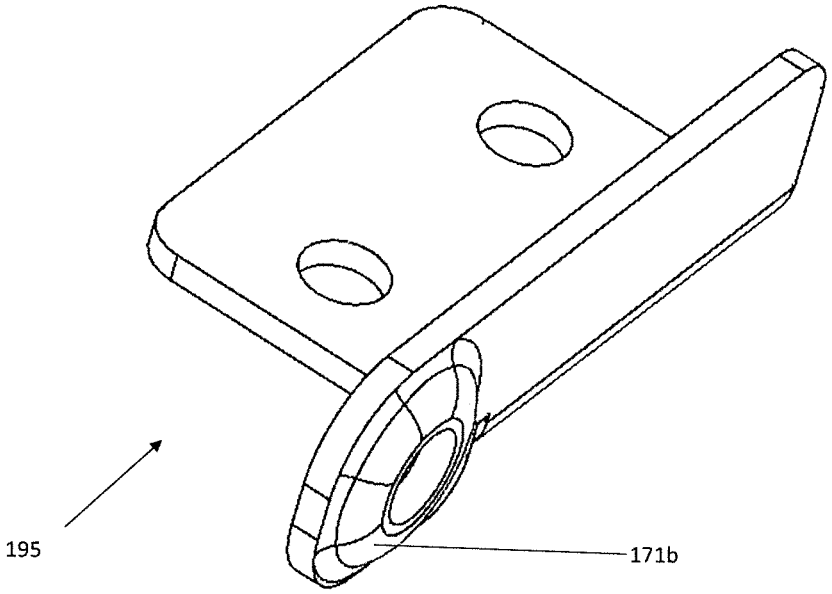
Figure 25:
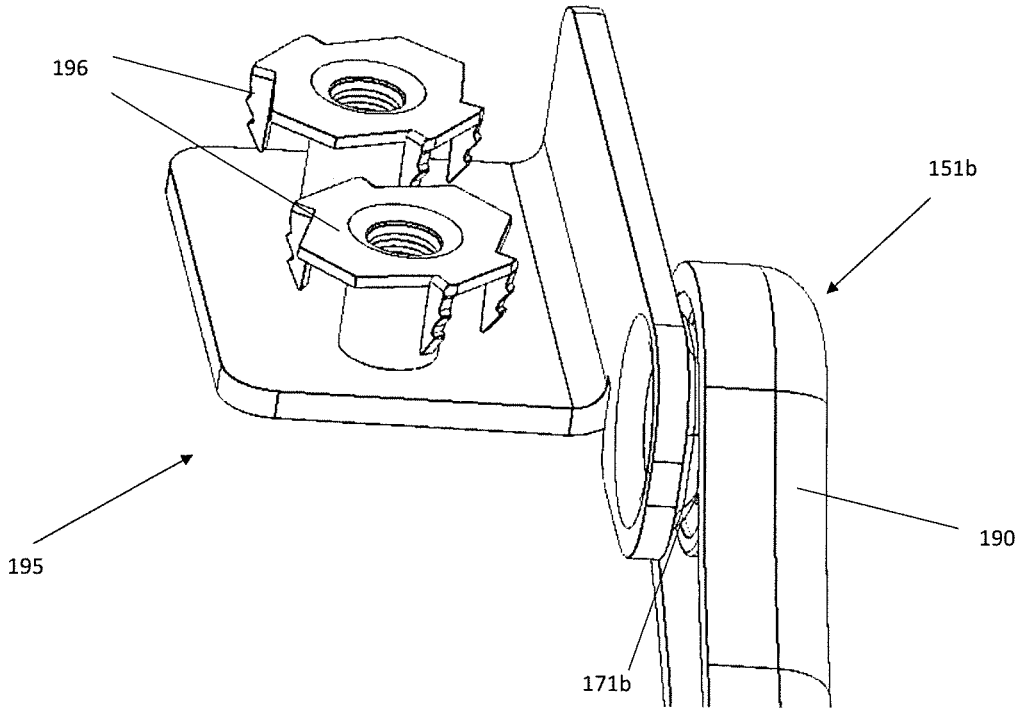

Arms 144 extend from cross-member 146 and have a roller bearing 152 at one end which is identical to bearing 52, and is pivotally connected to the frame 120 at the other end at pivot point 148 by an integral bearing housing 151 identical to the bearing housing 51, and a raised portion 171 located on bracket 150, the raised portion 171 being identical to the raised portion 71 (FIG. 20). A corner brace 199 is provided between the arms 144 and cross-member 46 to provide rigidity. The bracket 150 is fixed to and depends from the frame 120. The bearing housing 151 retains a bearing assembly (not shown) in the same way as described in relation to bearing housing 51 and bearing assembly 53. The pivotal connection between the bracket 150 and arm 144 is provided in the same was as described in relation to the bracket 50 and arm 44.

The bearing housing 151 and the bearing assembly is located on the arms 144*a* (first component) and the raised portion 171 is located on bracket 150 (second component) which is in contrast to the pivotal connection between bracket 50 and arm 44 where the raised portion 71 is provided on the arm 44 and the bearing housing 51 and bearing assembly 53 is provided on the bracket 50. It will be appreciated therefore that the bearing housing and assembly can be provided on one of the first or second components, and the feature, such as the bracket with the raised portion can be provided on the other of the first and second components to provide the pivotal connection.

Arms 190 are pivotally connected to the arms 144 at pivot point 191, which is positioned approximately mid-way along the length of arms 144, via a raised portion 171*a* which engages with a bearing assembly (not shown) identical to bearing assembly 53, housed within an integral bearing housing 151*a* on one end of the arm 190. Raised portion 171*a* (FIG. 21) is identical to raised portion 171, and the integral bearing housing 151*a* is identical to the integral bearing housing 151. The pivotal connection between the raised portion 171*a* of arm 144 and arm 190 is provided in the same was as described in relation to the bracket 50 and arm 44.

Arms 190 have another integral bearing housing 151*b* identical to integral bearing housing 151*a*, at their other end which is pivotally connected to a bracket 195 which is fixed to the underside of the thigh support panel 117 using fixing means such as screws 196. The bracket 195 includes a raised portion 171*b* (FIG. 24) which is identical to raised portions 71, 171*a*. The integral bearing housing 151 retains a bearing assembly (not shown) identical to bearing assembly 53. The pivotal connection between the raised portion 171*b* of arm 190 and bracket 195 is provided in the same was as described in relation to the bracket 50 and arm 44. The bracket 195 is positioned on the thigh support panel 117 such that the pivotal connection is about an axis which is close to the hinge point 143 between panels 117 and 118. It will be appreciated that the bracket 195 can be positioned anywhere on the length of the panel 117 providing that position enables pivotal movement of panels 117 and 118 between the lowered and the raised positions.

Figure 17:
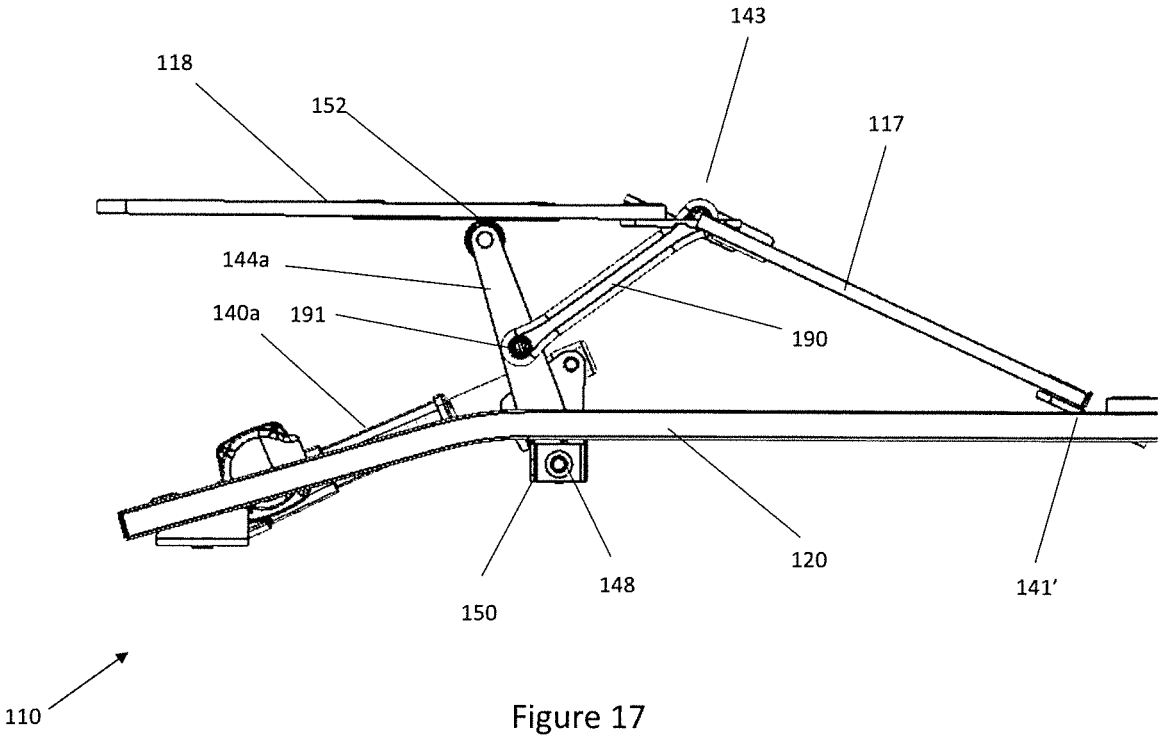
FIG. 17 is a side elevation view of an alternative bed with the foot support in a fully raised position.
Figure 18:
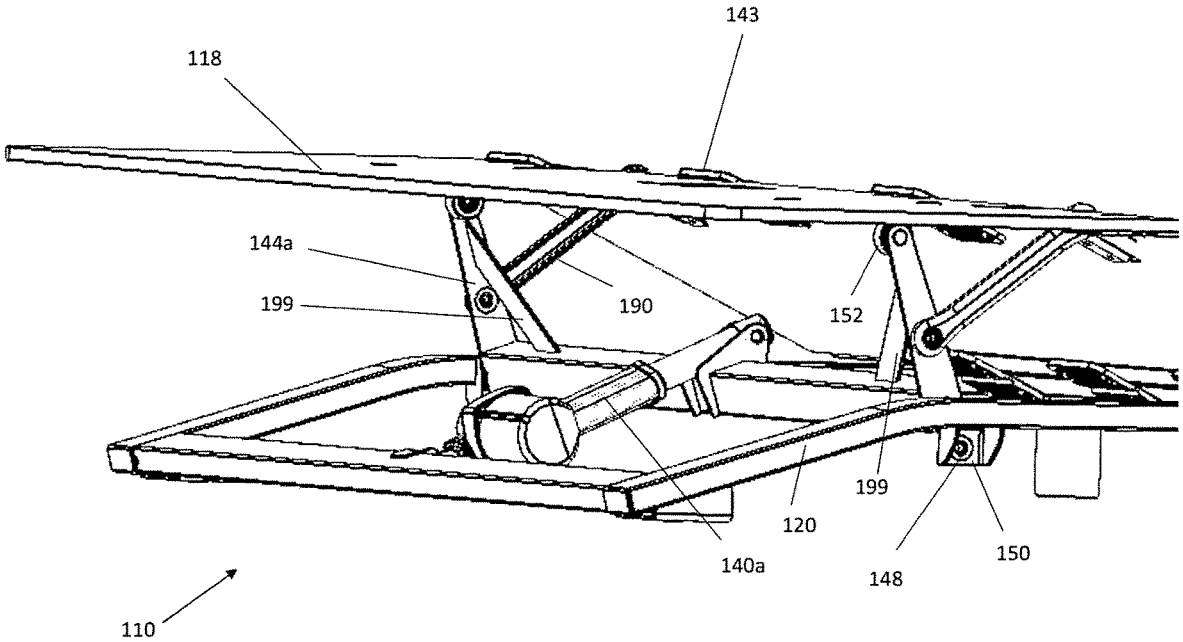
FIG. 18 is a perspective view of the bed of FIG. 17 with the foot support in a fully raised position.
Figure 19:
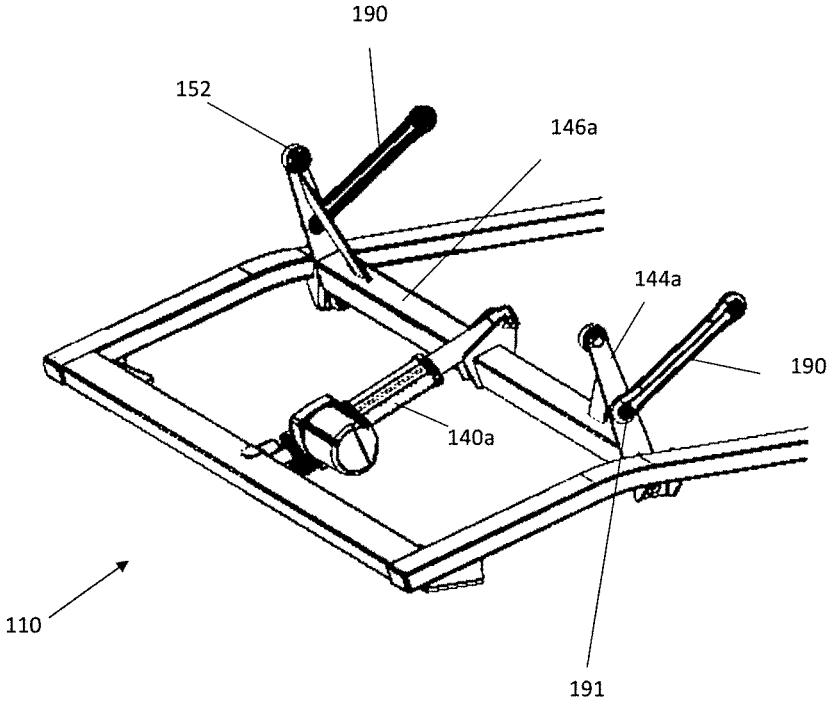
FIG. 19 is a perspective view of the bed of FIG. 17*with* the support panels removed.

In operation, activation of the linear electrical actuator 140*a* causes the cross-member 146*a* and arms 44*a* to rotate about pivot point 148. As arms 144*a* rotate, the bearing 152 acts on the underside of panel 118 causing it to be raised relative to the frame 120. Simultaneously, rotation of arms 144 causes the pivotally connected arms 190 to rotate and act against the underside of panel 117 causing panel 17 to rotate relative to the frame 120 about hinge 122' (FIG. 17). Thus, operation of the actuator 140*a* drives both panels 117 and 118 at the same time by virtue of the first (arm 144) and second (arm 190) connecting means.

Figure 26:
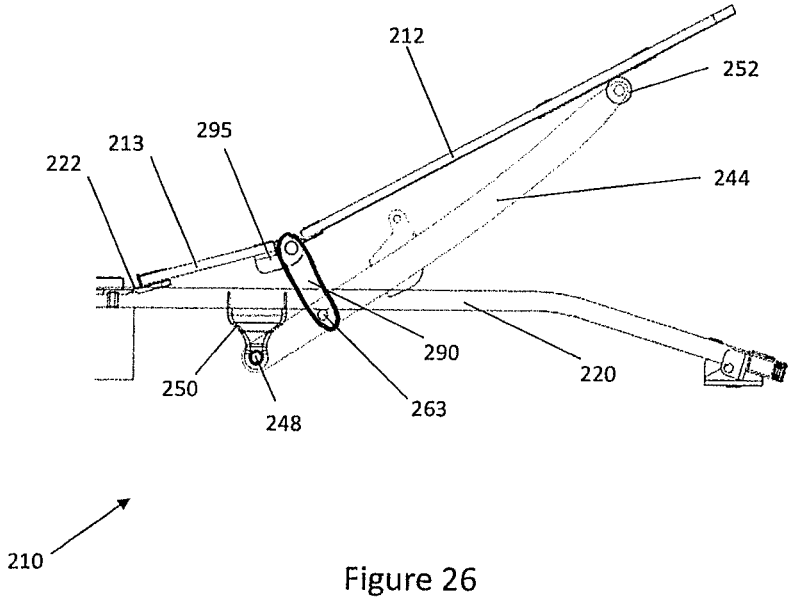
FIG. 26 is a side elevation view of an alternative bed with the back support in a semi-upright configuration.

With reference to FIG. 26, an alternative bed 210 is identical to the bed described in FIGS. 1 to 16 except that instead of a single connecting means in the form of arm 44 acting on panel 12, a first and second connecting means is used to drive panels 212 and 213 in the same way as actuator 40*a* drives panels 117 and 118 in the embodiment of FIGS. 17 to 25. The first connecting means in the form of arm 244 is identical to arm 44 except it further includes and additional raised portion 263 which is identical to the raised portion 63 similarly positioned on arm 44. The raised portion 263 enables a pivotal connection to be made with a second connecting means in the form of arm 290 which is identical to arm 190. Bracket 250 is identical to bracket 50 and is pivotally connected to arm 244 in the same way as bracket 50 is connected to arm 44. The raised portion 263 is positioned approximately three-quarters of the way along the length of the arm 244 towards the bracket 250. The raised portion 263 is positioned along the length of arm 244 to provide the required relative rotation between panels 213 and 212 as they are moved between lowered and raised configurations relative to the frame 220.

Operation is similar to the way actuator 40*a* drives panels 117 and 118 in the embodiment of FIGS. 17 to 25 Activation of the linear electrical actuator (not shown but identical to actuator 40) causes the arms 244 to rotate about pivot point 248. As arms 244 rotate, the bearing 252 acts on the underside of panel 212 causing it rotate relative to the frame 220. Simultaneously, rotation of arms 244 causes the pivotally connected arms 290 to rotate and act against the underside of panel 213 at a bracket 295 causing panel 213 to rotate relative to the frame 220 about hinge 222'. Thus, operation of the actuator drives both panels 212 and 213 at the same time by virtue of the first (arm 244) and second (arm 290) connecting means.

It will be understood that in the embodiments of FIGS. 1 to 26, at least two concepts have been described. One concept relates to the provision of first and second connecting means which act on panels of an adjustable bed to enable coordinated pivotal movement of the panels. A second concept relates to providing a bearing assembly to allow pivotal movement between components of an adjustable bed. Furthermore, the two concepts have been described in relation to pivotal movement between lumbar and back support panels and to pivotal movement between foot and thigh support panels. It will be appreciated that the two concepts can be used independently of each other, and that each of the concepts can be used to provide pivotal movement between lumbar and back support panels and/or to pivotal movement between foot and thigh support panels.

It will also be understood that whilst the above embodiments have been described in relation to an adjustable bed, the concepts also can be applied to an adjustable chair. For example, a bearing assembly and housing can be used to provide a pivotal connection between moving components of the chair such as an actuator supported on a fixed based section and a moveable seat section which is pivotally connected to the actuator. Similarly, first and second connecting means can be used to simultaneously move support panels on a chair.

Various operations may be described as multiple discrete operations in turn, in a manner that may be helpful in understanding embodiments of the present invention; however, the order of description should not be construed to imply that these operations are order dependent.

Although only a few embodiments have been disclosed in detail above, other embodiments are possible and the inventors intend these to be encompassed within this specification. The specification describes certain technological solutions to solve the technical problems that are described expressly and inherently in this application. This disclosure describes embodiments, and the claims are intended to cover any modification or alternative or generalization of these embodiments which might be predictable to a person having ordinary skill in the art.

Having described at least one of the preferred embodiments of the present invention with reference to the accompanying drawings, it will be apparent to those skills that the invention is not limited to those precise embodiments, and that various modifications and variations can be made in the presently disclosed system without departing from the scope or spirit of the invention. Thus, it is intended that the present disclosure cover modifications and variations of this disclosure provided they come within the scope of the appended claims and their equivalents.

What is claimed is:

1. An article of adjustable furniture, comprising:

at least one support section adjustably mounted for pivotal movement on a support frame of the adjustable furniture and a drive mechanism including an electrically powered actuator operable to effect pivotal movement of the at least one support section to move the at least one support section between a flat lowered position and a raised position;

the drive mechanism including at least a first and a second component pivotally joined by a bearing assembly, such that operation of the actuator causes pivotal movement between the first and second components so as to effect pivotal movement of the at least one support section;

wherein the bearing assembly comprises a bearing with an inner race and an outer race rotationally moveable relative to each other, in which the outer race is rotationally fixed relative to one of the first or second components;

the inner race is rotationally fixed relative to the other of the first or the second components such that operation of the drive mechanism causes relative movement between the inner and outer race to cause pivotal movement between the first and second components so as to effect pivotal movement of the at least one support section;

the actuator having a first end and a second end; and in which the first end of the actuator is pivotally connected to the support frame and the second end of the actuator is pivotally connected to the second component.

2. The article of adjustable furniture, according to claim 1, wherein:

one of the first or second components includes an integral bearing housing arranged to form an interference fit with the outer race such that the outer race is rotationally fixed relative to one of the first or second components.

3. The article of adjustable furniture, according to claim 2, wherein:

the other of the first or second components includes a fixing feature arranged to form an interference fit with the inner race such that the inner race is rotationally fixed relative to the other of the first or second components.

4. The article of adjustable furniture, according to claim 2, wherein:

the interference fit is a crimped fit.

5. The article of adjustable furniture, according to claim 1, wherein:

in which the first component is said actuator and the second component is a first connecting means.

6. The article of adjustable furniture, according to claim 1, wherein:

in which the at least one support section is a plurality of articulated support sections;

said plurality of articulated support sections including at least one adjustable first support section and at least one adjustable second support section; and the actuator effecting co-ordinated pivotal movement angularly adjusts the at least one adjustable first support section relative to the at least one adjustable second support section, in which the actuator is operable to drive a first connecting means to act directly on the first support section, and a second connecting means to act directly on the second support section or a pivotal point connecting the first and second support sections such that the actuator simultaneously drives both support sections.

7. The article of adjustable furniture, according to claim 6, wherein:

the second connecting means is driven by the actuator via the first connecting means.

8. The article of adjustable furniture, according to claim 6, wherein:

one of the first and second support sections is free to pivot relative to the other of the first and second support sections independently of the actuator.

9. The article of adjustable furniture, according to claim 6, wherein:

the second connecting means is pivotally attached to the first connecting means.

10. The article of adjustable furniture, according to claim 9, wherein:

the second connecting means has a first end and a second end, the first end is pivotally attached to the first connecting means, the second end is pivotally attached to the second support section.

11. The article of adjustable furniture, according to claim 6, wherein:

the first connecting means has a first end pivotally attached to a frame of the furniture, and a second end free to move translationally relative to the first support section.

12. The article of adjustable furniture, according to claim 6, wherein:

the first connecting means comprises a bar and a pair of spaced apart stays projecting substantially perpendicularly from the bar, the actuator is pivotally attached to the bar.

13. The article of adjustable furniture, according to claim 6, wherein:

the second connecting means is pivotally positioned on the first connecting means to limit the angular movement between the first and second support sections.

14. The article of adjustable furniture, according to claim 6, wherein:

the first and second support sections are selected from one of the following pairs:

the first support section is a foot support section and the second support section is a thigh support section; the first support section is a back support section and the second support section is a neck support section; and the first support section is a lumbar support section and the second support section is a back support section.

15. The article of adjustable furniture, according to claim 1, wherein:

the furniture is a chair comprising a floor standing base section, the at least one support section is a seat support section pivotally movable relative to the base section, the first component is the actuator fixed to the base section and the second component is a bracket fixed on the seat support section, such that the bearing assembly provides a pivotal connection between the actuator and the bracket to cause pivotal movement between the base section and the seat support section.

16. An article of adjustable furniture, comprising:

at least one support section adjustably mounted for pivotal movement on a support frame of the adjustable furniture, and a drive mechanism including an electrically powered actuator operable to effect pivotal movement of the at least one support section to move the at least one support section between a flat lowered position and a raised position; the actuator having a first end and a second end;

the drive mechanism including at least a first and a second component pivotally joined by a bearing assembly, such that operation of the actuator causes pivotal movement between the first and second components so as to effect pivotal movement of the at least one support section;

wherein the bearing assembly comprises a bearing with an inner race and an outer race rotationally moveable relative to each other, in which the outer race is rotationally fixed relative to one of the first or second components;

the inner race is rotationally fixed relative to the other of the first or the second components such that operation of the drive mechanism causes relative movement between the inner and outer race to cause pivotal movement between the first and second components so as to effect pivotal movement of the at least one support section;

the actuator having a first end and a second end;

in which the first end of the actuator is pivotally connected to the support frame and the second end of the actuator is pivotally connected to the second component; and in which the first component is the support frame of the furniture and the second component is a first connecting means which is pivotally connected to the support frame.

17. An article of adjustable furniture, comprising:

an upper body support panel adjustably mounted for pivotal movement on a support frame of the adjustable furniture, and a drive mechanism including an electrically powered actuator operable to effect pivotal movement of the upper body support panel to raise the upper body support panel between a flat lowered position and a raised position;

the drive mechanism including at least a first and a second component pivotally joined by a bearing assembly, such that operation of the actuator along an actuator direction causes pivotal movement between the first and second components so as to effect pivotal movement of the upper body support panel;

wherein the bearing assembly comprises a bearing with an inner race and an outer race rotationally moveable relative to each other, in which the outer race is rotationally fixed relative to one of the first or second components;

the inner race is rotationally fixed relative to the other of the first or the second components such that operation of the drive mechanism causes relative movement between the inner and outer race to cause pivotal movement between the first and second components so as to effect pivotal movement of the upper body support panel;

the actuator having a first end and a second end;

in which the first end of the actuator is pivotally connected to the support frame and the second end of the actuator is pivotally connected to the second component; and in which the first component is the support frame of the furniture and the second component is a first connecting means which is pivotally connected to the support frame.

18. An article of adjustable furniture, comprising:

an upper body support panel adjustably mounted for pivotal movement on a support frame of the adjustable furniture, and a drive mechanism including an electrically powered actuator operable to effect pivotal movement of the upper body support panel to raise the upper body support panel between a flat lowered position and a raised position; the actuator having a first end and a second end;

the drive mechanism including at least a first and a second component pivotally joined by a bearing assembly, such that operation of the actuator causes pivotal movement between the first and second components so as to effect pivotal movement of the upper body support panel;

wherein the bearing assembly comprises a bearing with an inner race and an outer race rotationally moveable relative to each other, in which the outer race is rotationally fixed relative to one of the first or second components;

the inner race is rotationally fixed relative to the other of the first or the second components such that operation of the drive mechanism causes relative movement between the inner and outer race to cause pivotal movement between the first and second components so as to effect pivotal movement of the upper body support panel;

the actuator having a first end and a second end;

in which the first end of the actuator is pivotally mounted to the support frame and the second end of the actuator is pivotally connected to the second component; and in which the first component is the support frame of the furniture and the second component is a first connecting means.

19. A bed comprising:

an upper body support panel adjustably mounted for pivotal movement on a support frame of the bed, and a drive mechanism including an electrically powered actuator operable to effect pivotal movement of the upper body support panel to raise the upper body support panel between a flat lowered position and a raised position; the actuator having a first end and a second end;

the drive mechanism including at least a first and a second component pivotally joined by a bearing assembly, such that operation of the actuator causes pivotal movement between the first and second components so as to effect pivotal movement of the upper body support panel;

wherein the bearing assembly comprises a bearing with an inner race and an outer race rotationally moveable relative to each other, in which the outer race is rotationally fixed relative to one of the first or second components;

the inner race is rotationally fixed relative to the other of the first or the second components such that operation of the drive mechanism causes relative movement between the inner and outer race to cause pivotal movement between the first and second components so as to effect pivotal movement of the upper body support panel;

the actuator having a first end and a second end;

in which the first end of the actuator is pivotally mounted to the support frame and the second end of the actuator is pivotally connected to the second component; and in which the first component is the support frame of the furniture and the second component is a first connecting means.

* * * * *